US009056459B2

(12) United States Patent
Furuno

(10) Patent No.: US 9,056,459 B2
(45) Date of Patent: Jun. 16, 2015

(54) INKJET RECORDING DEVICE AND INKJET RECORDING METHOD

(75) Inventor: Kumiko Furuno, Shiki (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/240,685

(22) PCT Filed: Aug. 21, 2012

(86) PCT No.: PCT/JP2012/071044
§ 371 (c)(1),
(2), (4) Date: Feb. 24, 2014

(87) PCT Pub. No.: WO2013/027715
PCT Pub. Date: Feb. 28, 2013

(65) Prior Publication Data

US 2014/0198145 A1 Jul. 17, 2014

(30) Foreign Application Priority Data

Aug. 24, 2011 (JP) ..... 2011-183172

(51) Int. Cl.
*B41J 29/38* (2006.01)
*B41J 2/045* (2006.01)

(52) U.S. Cl.
CPC ..... *B41J 2/04581* (2013.01); *B41J 2/04525* (2013.01); *B41J 2/04588* (2013.01); *B41J 2/04596* (2013.01); *B41J 2202/10* (2013.01)

(58) Field of Classification Search
CPC ..... B41J 2/04573; B41J 2/04581; B41J 2/04588; B41J 2/14032; B41J 2002/14459
USPC ..... 347/9–12, 68
See application file for complete search history.

(56) References Cited

U.S. PATENT DOCUMENTS

| | | | | |
|---|---|---|---|---|
| 8,186,797 | B2 * | 5/2012 | Okura et al. | 347/18 |
| 2008/0166495 | A1 * | 7/2008 | Maeno et al. | 427/493 |
| 2009/0289982 | A1 * | 11/2009 | Hasenbein | 347/11 |

FOREIGN PATENT DOCUMENTS

| | | | | |
|---|---|---|---|---|
| JP | 07164629 | A | | 6/1995 |
| JP | 07241986 | A | | 9/1995 |
| JP | 2000-15803 | A | | 1/2000 |
| JP | 2001315330 | A | | 11/2001 |
| JP | 2003-80714 | A | | 3/2003 |
| JP | 2003080714 | A | * | 3/2003 |
| JP | 2004-262237 | A | | 9/2004 |

(Continued)

OTHER PUBLICATIONS

International Search Report for International Application No. PCT/JP2012/071044, mailed Oct. 2, 2012, with English Translation.

*Primary Examiner* — Julian Huffman
*Assistant Examiner* — Sharon A Polk
(74) *Attorney, Agent, or Firm* — Cantor Colburn LLP

(57) ABSTRACT

An inkjet recording device may include a plurality of pressure-generating chambers compartmented by walls including electromechanical conversion devices for generating a pressure; nozzles connected to the pressure-generating chambers; an ink supply portion; and a drive pulse generation device for driving said electromechanical conversion devices. The pressure-generating chambers may be separated into a plurality of groups. The pressure-generating chambers in each group may be driven in series so as to eject ink drops from said nozzles.

9 Claims, 14 Drawing Sheets

(56) References Cited

FOREIGN PATENT DOCUMENTS

| | | | | |
|---|---|---|---|---|
| JP | 2005-212413 | A | | 8/2005 |
| JP | 2006-272950 | A | | 10/2006 |
| JP | 2006272950 | A | * | 10/2006 |
| JP | 2008-44265 | A | | 2/2008 |
| JP | 2008-162262 | A | | 7/2008 |
| JP | 2009-90649 | A | | 4/2009 |
| JP | 2010-143110 | A | | 7/2010 |
| JP | 2010143110 | A | * | 7/2010 |
| JP | 2010-194998 | A | | 9/2010 |
| JP | 2011-523384 | A | | 8/2011 |

* cited by examiner

INKJET RECORDING DEVICE AND INKJET RECORDING METHOD

This is the U.S. national stage of application No. PCT/JP2012/071044, filed on 21 Aug. 2012. Priority under 35 U.S.C. §119(a) and 35 U.S.C. §365(b) is claimed from Japanese Application No. 2011-183172, filed 24 Aug. 2011, the disclosure of which is also incorporated herein by reference.

TECHNICAL FIELD

The present invention relates to an inkjet recording device and an inkjet recording method.

BACKGROUND

Various types of inkjet heads are being proposed and developed, one of which is a sharing mode type inkjet head (Patent Documents 1 to 3).

Specifically, the sharing mode type inkjet head ejects ink drops from nozzles connected to a plurality of pressure-generating chambers for generating a pressure by deforming walls composed of an electromechanical conversion means by operating the electromechanical conversion means that are compartmented by the walls.

In recent years, there have been increasing needs for quickly forming an image on various types of media using an inkjet head. For instance, when an image is formed on a non-absorbable recording material or a slightly absorbable recording material, an ink can fail to readily spread on a recording material. Specifically, it is hard to form an image of a solid portion, thereby generating a void or a white stripe. Therefore, there have been reported some needs for slightly widening the ink dot diameter after ink droplets land or slightly increasing the amount of droplets in order to improve image quality.

In response to these needs, Patent Document 1 discloses a method for increasing the volume of droplets by making the pulse width of an expanded pulse (normally 1AL) odd-number times thereof such as 3AL or more.

In addition, Patent Documents 2 and 3 propose increasing the pulse width of an expanded pulse to 1AL or more, aimed at achieving favorable ink ejection and stable high frequency driving.

PRIOR ART DOCUMENT

Patent Documents

Patent Document 1: JP-A-7-241986
Patent Document 2: JP-A-7-164629
Patent Document 3: JP-A-2001-315330

SUMMARY OF THE INVENTION

Problems to be Solved by the Invention

However, the pulse width of an expanded pulse, if it is made longer than 1AL, can lead to reduced discharge efficiency and required increase in drive voltage of the expanded pulse. When the size change is introduced in a 3-cycle driving system, a meniscus of adjacent channels is significantly extruded, resulting in disadvantageously unstable ink discharge.

Specifically, in a 3-cycle driving head, adjacent pressure-generating chambers share walls composed of an electromechanical conversion means. Accordingly, when a pressure-generating chamber is driven, a meniscus is extruded from a nozzle of an adjacent non-driven pressure-generating chamber, and when the non-driven pressure-generating chamber is subsequently driven, the discharge can be unstable, thereby posing a key cross talk problem. When the drive voltage of an expanded pulse is increased in order to increase the amount of droplets, the positive ink pressure in an adjacent non-driven pressure-generating chamber is increased, thereby making it increasingly difficult to solve this type of cross talk problem.

When a contraction pulse for generating a positive pressure in a pressure-generating chamber is applied in addition to an expanded pulse using an expanded pulse width of 3AL or more disclosed in Patent Document 1, drive frequency and then running speed decline.

To solve the above problems, the present invention provides an inkjet recording device and an inkjet recording method that are capable of controlling a reduction in drive frequency, widening the dot diameter by increasing the flow rate of an ink drop while maintaining ejection stability when applied to a 3-cycle driving, by setting the pulse width of an expanded pulse and the negative pressure of a meniscus within predetermined ranges, and readily adjusting the flow rate corresponding to a recording material.

Another problem of the present invention will be described in more detail.

Means for Solving the Problems

The above problems will be solved by each of the following inventions.

1. An inkjet recording device comprising: a plurality of pressure-generating chambers compartmented by walls composed of electromechanical conversion devices for generating a pressure by deforming said walls by operating said electromechanical conversion devices; nozzles connected to the pressure-generating chambers for ejecting ink drops by operating the pressure; an ink supply portion for supplying an ink containing a pigment to said pressure-generating chambers; and a drive pulse generation device for driving said electromechanical conversion devices, wherein by separating said pressure-generating chambers into a plurality of groups, one group consisting of adjacent 3 pressure-generating chambers sandwiching said walls, said pressure-generating chambers in each group are driven in series so as to eject ink drops from said nozzles, wherein said drive pulse generation device ejects an ink drop from said nozzle by applying a first drive pulse for generating a negative pressure in said pressure-generating chamber on condition that the applying pressure on a meniscus in said nozzle is set within a range of −20 cmAq or more and −5 cmAq or less, and a second drive pulse for subsequently generating a positive pressure in said pressure-generating chamber to said electromechanical conversion device and the pulse width W1 of said first drive pulse is set within a range of $1.4AL \leq W1 < 1.8AL$ on condition that AL is one half of the acoustic resonance of a pressure wave in said pressure-generating chamber.

2. The inkjet recording device according to 1, wherein the pulse width W2 of said second drive pulse is 2AL.

3, The inkjet recording device according to 1 or 2, wherein said first drive pulse and said second drive pulse are a square wave.

4. The inkjet recording device according to any of 1 to 3, wherein said drive pulse generation device applies said first drive pulse and said second drive pulse to said electromechanical conversion device of said pressure-generating chamber for ejecting an ink drop from said nozzle, and applies only said second drive pulse to said electromechanical conversion device of said pressure-generating chamber for ejecting no ink drop from said nozzle.

5. The inkjet recording device according to any of 1 to 4, wherein the speed of an ink drop from said nozzle after 0.5 mm flight is 6 m/s or more and 8 m/s or less.

6. The inkjet recording device according to any of 1 to 5, wherein said ink is an aqueous ink.

7. The inkjet recording device according to any of 1 to 5, wherein said ink is a UV ink.

8. An inkjet recording method, wherein an image is recorded by ejecting an ink on a non-absorbable recording material or a slightly absorbable recording material as a recording material using the inkjet recording device according to any of 1 to 7.

9. The inkjet recording method according to 8, wherein a process of heating said recording material from a rear surface of an image-recording surface at least in any one of cases where said recording material is heated before, while and after recording an image is included.

Effect of the Invention

The present invention can provide an inkjet recording device and an inkjet recording method that are capable of controlling a reduction in drive frequency, widening the dot diameter by increasing the flow rate of an ink drop while maintaining ejection stability when applied to a 3-cycle driving, by setting the pulse width of an expanded pulse and the negative pressure of a meniscus within predetermined ranges, and readily adjusting the flow rate corresponding to a recording material.

DESCRIPTION OF THE PREFERRED EMBODIMENTS

A preferred embodiment of the present invention will be described with reference to the drawings.

(Overall Configuration of Inkjet Recording Device)

Figure 1:
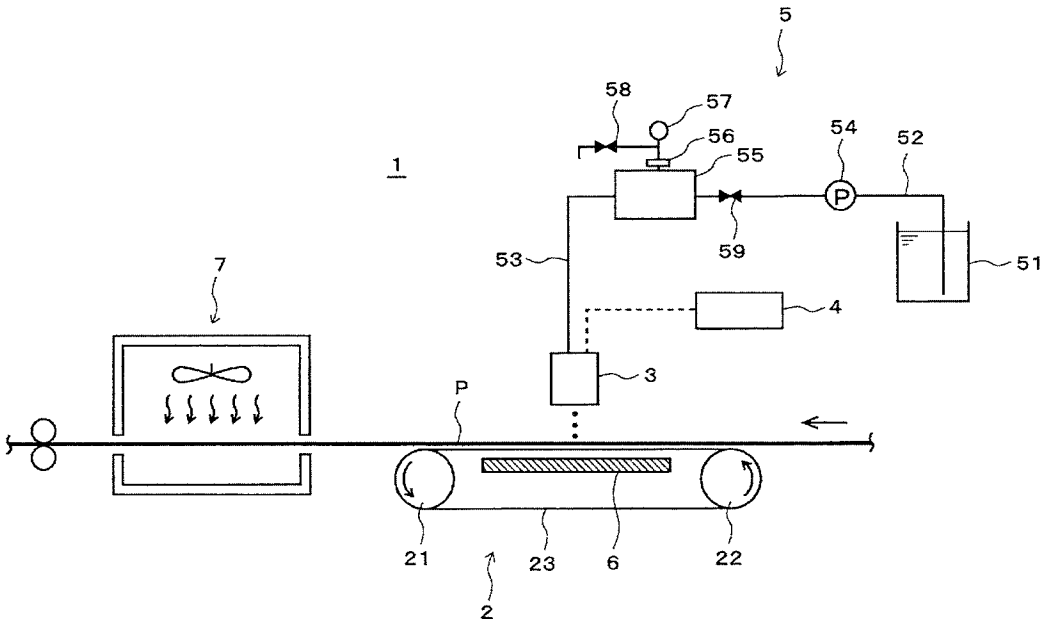
FIG. 1 is a schematic block diagram showing one example of the inkjet recording device according to the present invention.

FIG. 1 is a schematic block diagram showing one example of the inkjet recording device according to the present invention.

An inkjet recording device 1 has a conveying means 2 composed of an endless belt 23 stretched between a plurality of rollers 21,22, and a recording material P is placed on an upper surface of the endless belt 23 to convey the recording material P in a direction indicated by an arrow in the figure by a rotating drive of the endless belt 23. Herein, illustrative example of the recording material P includes a lengthy web recording material, but may be a sheet-like recording material cut into a predetermined size in advance.

The surface of the recording material P placed on the upper surface of the endless belt 23 is an image-recording surface, and a record head 3 is disposed above the recording material P at a predetermined interval so that the record head 3 faces the surface of the recording material P. The record head 3 is provided with many nozzles formed on a nozzle surface thereof facing the surface of the recording material P to selectively eject an ink drop from the nozzle corresponding to image data, form dots on the surface of the recording material P and record and form a desired inkjet image.

The record head 3 is reciprocatably provided in a width direction of the recording material P (in a direction perpendicular to a drawing). Specifically, the record head 3 may be a serial-type (or shuttle-type) record head that records and forms an image by reciprocating motion of the record head 3 and intermittent conveying of the recording material P by the conveying means 2 to record and form an image, or a line-type record head whose length exceeds the width of the recording material P disposed in a fixed manner, Particularly in the present invention, the latter line-type record head can preferably be used, because it requires strict criteria to prevent nozzle clogging by recording and forming an image by using one-pass inkjet system having only one relative motion relative to the recording material P.

The line-type record head may be a long head having a nozzle array composed of many nozzles in a width direction of the recording material P, or a record head unit composed of a long nozzle array stretching in a width direction of the recording material P by nozzles of each head in a unit having a plurality of relatively short and small heads. Use of a line-type record head can record images in larger quantities for a shorter period of time than a shuttle-type record head to significantly improve productivity.

Herein, only the single record head 3 is described, but the inkjet recording device 1 may comprise a plurality of record heads (record head unit) corresponding to ink color such as YMCK.

The record head 3 is electrically connected with a drive pulse generating portion 4 as a drive pulse generation means provided on a control board of the inkjet recording device 1 via FPC and so on to control the operation of ejecting an ink drop by a drive pulse transmitted from the drive pulse generating portion 4.

(Record Head)

Figure 2:
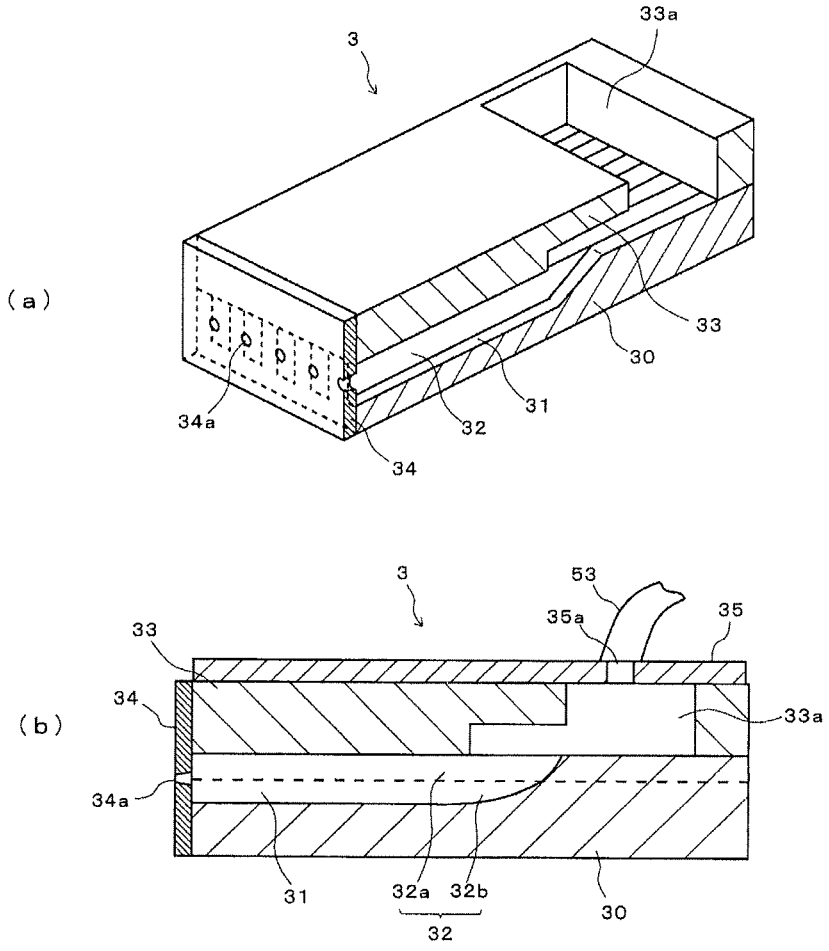
FIG. 2 (*a*) is a schematic perspective view showing one example of a sharing mode type record head, and FIG. 2 (*b*) is a cross sectional view thereof.

Next, one example of the record head 3 of the present invention will be described with reference to FIG. 2, FIG. 2 shows one example of a sharing mode type record head, and specifically a schematic perspective view in (a) and a cross sectional view in (b).

"30" in the record head 3 denotes a channel substrate. The channel substrate 30 is provided with many thin groove-like channels 31 and walls 32 so as to be alternately arranged. An upper surface of the channel substrate 30 is provided with a cover substrate 33 so as to block an upper part of all the channels 31. End faces of the channel substrate 30 and the cover substrate 33 are bonded to a nozzle plate 34 to form a nozzle surface on a surface of the nozzle plate 34. One end of each of the channels 31 is connected to the outside via a nozzle 34*a* formed at the nozzle plate 34.

The nozzle diameter is preferably 25 μm or more and 32 μm or less in the present invention. If the nozzle diameter is 25 μm or more, meniscus outflow can be reduced after ink ejection to obtain a stable ejection property. If the nozzle diameter is 32 μm or less, a meniscus in the nozzle 34*a* is not destroyed to obtain a stable ejection property.

Herein, the nozzle diameter means a diameter of an opening of an outlet side opening of the nozzle 34*a*. The outlet side opening of the nozzle 34*a* doesn't necessarily have a circular shape, but when the shape of the nozzle 34*a* is noncircular, the nozzle diameter means a diameter of a circle whose area is the same as that of the outlet side opening.

The other end of each of the channels 31 is formed so as to be gradually in the form of a shallow groove relative to the channel substrate 30 and connected to a common flow passage 33*a* commonly found in each of the channels 31 that is formed to open toward the cover substrate 33. The common flow passage 33*a* is further blocked by a plate 35 to supply an ink from an ink supply tube 53 to the common flow passage 33*a* and each of the channels 31 via an ink supply port 35*a* formed at the plate 35.

Each of the walls 32 is composed of a piezoelectric material such as PZT as an electromechanical conversion means. Herein, each of the walls 32 is formed of a piezoelectric material by subjecting an upper wall portion 32*a* and a lower wall portion 32*b* to polarization processing. The figure illustrates the upper wall portion 32*a* and the lower wall portion 32*b* whose polarization directions are opposite to each other. A portion formed by a piezoelectric material subjected to polarization processing may be only a portion denoted by a symbol 32*a* and may be at least part of the walls 32. The walls 32 are alternately arranged with the channels 31. Thus, one wall 32 is shared by both adjacent channels 31,31 thereof.

A drive electrode (not shown in FIG. 2) is each formed from a wall surface of both adjacent walls 32 to a bottom surface of the channels 31 in each channel 31. When a drive pulse of a predetermined voltage is each applied to both drive electrodes sandwiching the walls 32 from a drive pulse generating portion 4 (FIG. 1), walls 32 composed of the piezoelectric material will be bent and deformed from a joint surface between the upper wall portion 32*a* and the lower wall portion 32*b*. By bending deformation of the walls 32, a pressure wave is generated in the channels 31 to impart an ink in the channels 31 with a pressure for being ejected from the nozzle 34*a*. Accordingly, the inside of the channels 31 surrounded by the channel substrate 30, the cover substrate 33 and the nozzle plate 34 comprises a pressure-generating chamber in the present invention.

(Operation of Record Head of Ejecting an Ink Drop)

Prior to the operation of the record head 3 of ejecting an ink drop by deforming the walls 32, a basic operation of a record head of ejecting an ink drop will be further described with reference to FIGS. 3 to 6.

Figure 3:
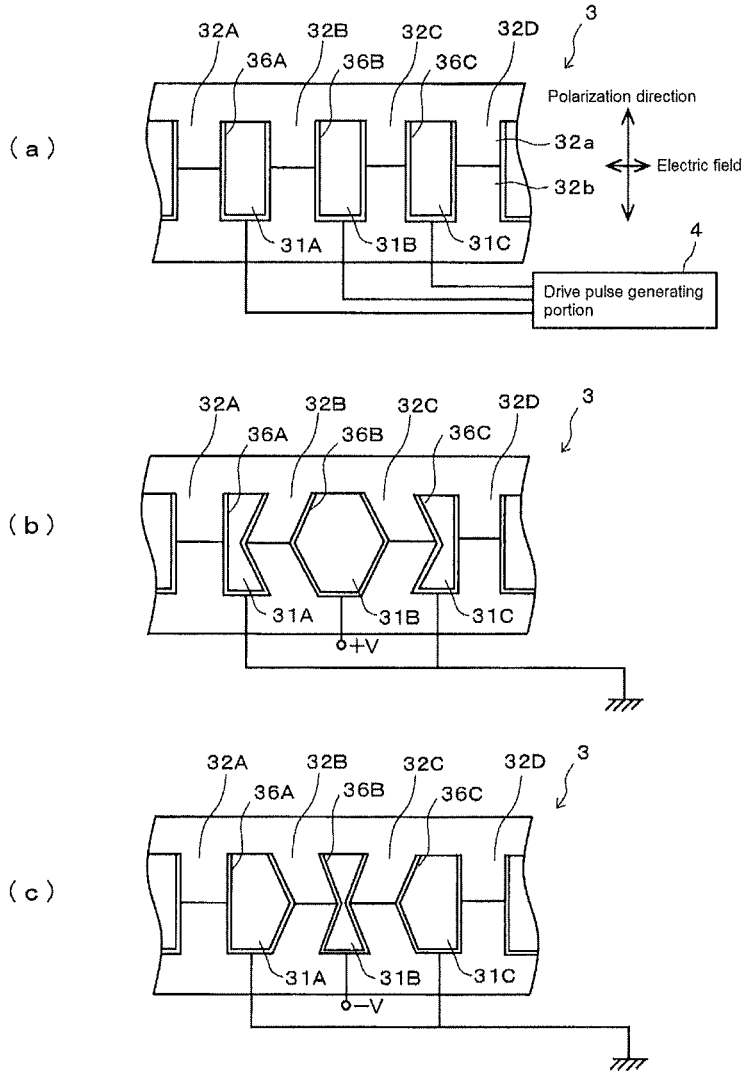
FIG. 3 is an explanatory diagram describing the operation of ejecting an ink drop of a record head.
Figure 4:
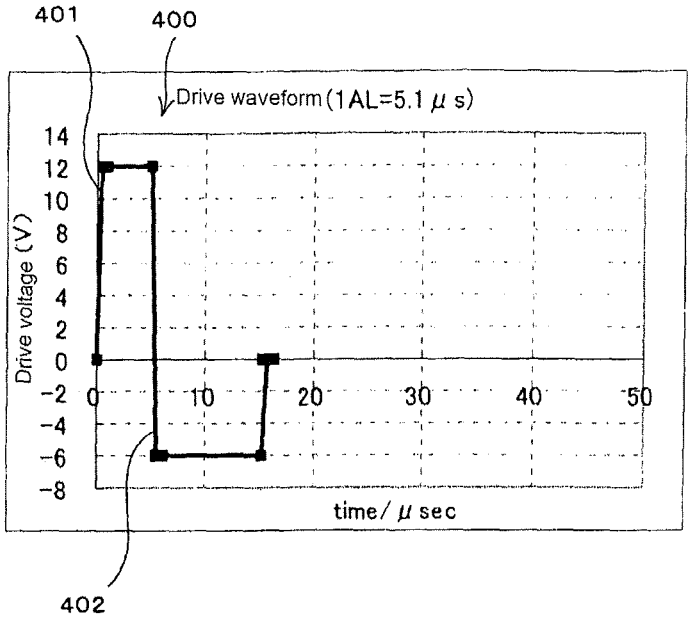
FIG. 4 is a figure showing one example of a commonly used drive pulse.
Figure 5:
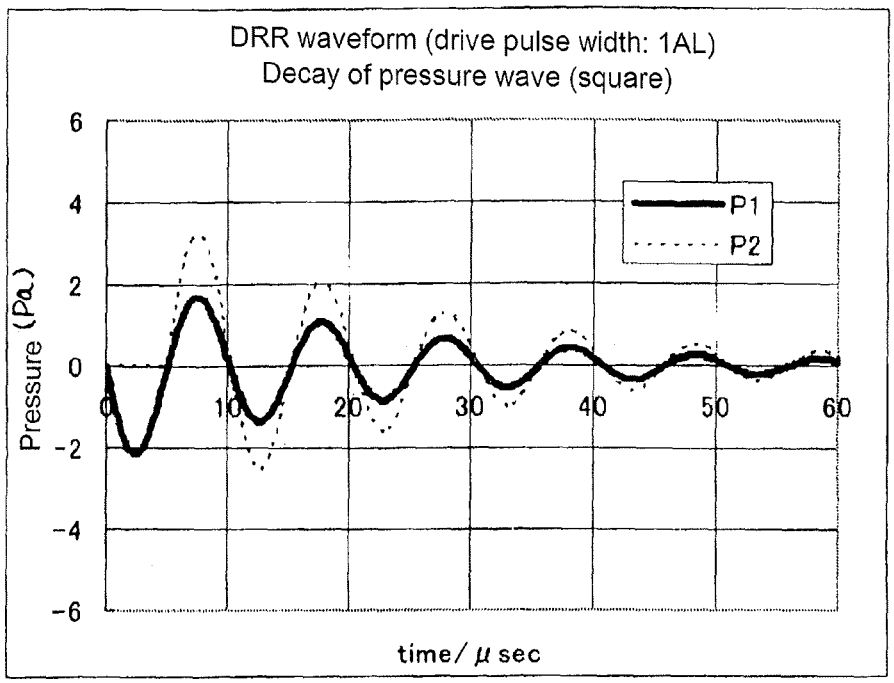
FIG. 5 is a graph showing pressure waves P1 and P2 in a channel when a drive pulse shown in FIG. 4 is applied thereto.
Figure 6:
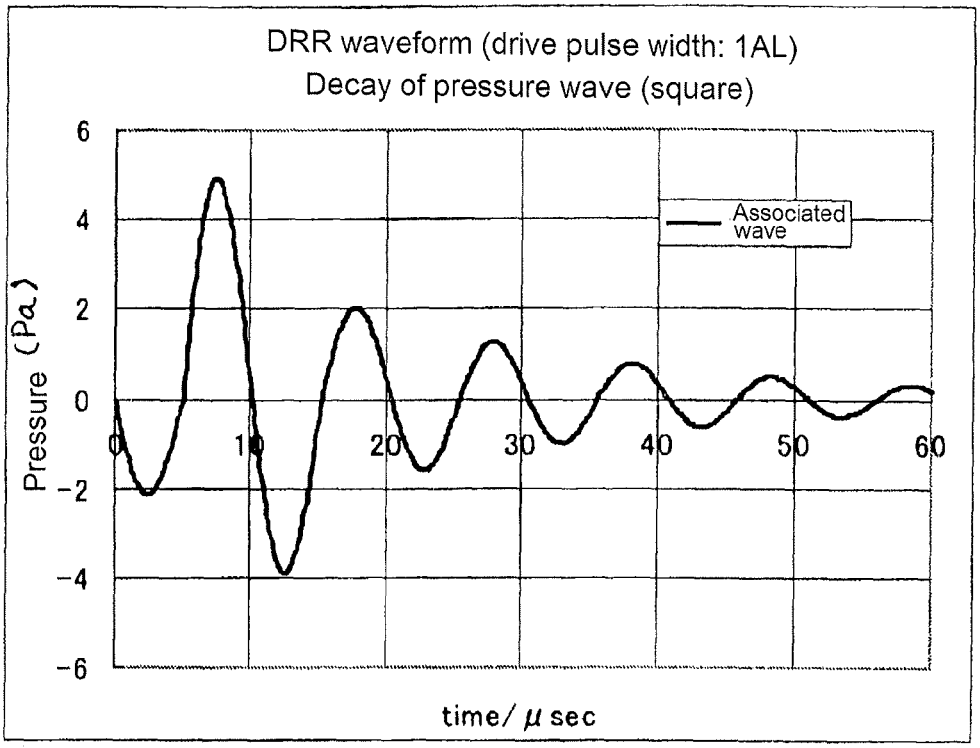
FIG. 6 is a graph showing an associated wave of pressure waves P1 and P2 in a channel when a drive pulse shown in FIG. 4 is applied thereto.

FIG. 3 is an explanatory diagram describing the operation of the record head 3 of ejecting an ink drop, and shows a cross section cut in a direction orthogonal to a lengthwise direction of the channels 31. FIG. 4 is a diagram showing one example of a conventional drive pulse, and FIGS. 5 and 6 are diagrams showing a pressure in a channel for ejecting an ink drop. Since the operation of each channel is identical, FIG. 3 shows only part of a plurality of channels. FIG. 3 shows no nozzle.

First, when a drive pulse is not applied to any of drive electrodes 36A, 36B, 36C each facing adjacent channels 31A, 31B, 31C, any of walls 32A, 32B, 32C, 32D shows no deformation. When an ink drop is ejected, drive electrodes 36A and 36C are grounded in the FIG. 3(*a*). Also, a drive pulse 400 shown in FIG. 4 is applied to the drive electrode 36B from the drive pulse generating portion 4.

The drive pulse 400 is a square wave comprising a first drive pulse 401 composed of a positive voltage (+Von) for generating a negative pressure in a channel and a second drive pulse 402 composed of a negative voltage (−Voff) for generating a positive pressure in a channel. The second drive pulse 402 is applied 1AL after maintaining the first drive pulse 401. Herein, drive voltages of the first drive pulse and the second drive pulse are illustrated as +Von=+12V and −Voff=−6V, respectively. The second drive pulse 402 is returned to zero potential 2AL after maintaining the drive voltage.

Herein, AL (acoustic length) means one half of the acoustic resonance period of a pressure wave in the channel 31. AL is calculated as a pulse width so that the flight speed of an ink drop is a maximum value, by measuring the speed of an ink drop ejected when a drive pulse of a square wave is applied to a drive electrode and changing the pulse width of the square wave on condition that the voltage value of the square wave is constant. Here, 1AL=5.1 μs.

The pulse is a square wave having a constant peak voltage defining 0V as 0% and a peak voltage as 100%, and the pulse width is defined as a duration from 10% of a rise time from and to 10% of a fall time from the peak voltage.

Moreover, the square wave means a waveform whose rise time and fall time between 10% and 90% of the voltage are both within one half of AL, preferably within ¼ thereof.

After the first drive pulse 401 in the drive pulse 400 is applied, an electric field is generated in a direction orthogonal to a polarization direction of a piezoelectric material as an electromechanical conversion means comprising the walls 32B, 32C. Accordingly, in both of the walls 32B, 32C, a shear deformation occurs on a joint surface of the upper wall portion 32*a* and the lower wall portion 32*b*. As shown in FIG. 3 (*b*), the walls 32B, 32C are each externally bent and deformed to increase the volume of the channel 31B. As shown in FIG. 5, the bending deformation generates a first pressure wave P1 in the channel 31B as a negative pressure wave to introduce an ink (Draw).

The first drive pulse 401 is maintained for 1AL, and soon after the pressure wave in the channel 31B converts from a negative pressure to a positive pressure, the first drive pulse 401 is returned to zero potential. Thereafter, the walls 32B, 32C are returned to a center position shown in FIG. 3 (*a*) from an enlarged position shown in FIG. 3 (*b*) to give a high pressure to an ink in the channel 31B (Release). Meanwhile, as shown in FIG. 3 (*c*), the second drive pulse 402 of a negative voltage is applied in a direction so as to decrease the volume of the channel 31B. Accordingly, as shown in FIG. 5, a second pressure wave P2 as a positive pressure wave is generated in the channel 31B (Reinforce). As shown in FIG. 6, since the first pressure wave P1 and the second pressure wave P2 share the peak of a positive pressure, a high pressure is generated in the channel 31B from an applied voltage, thereby efficiency ejecting an ink drop from the nozzle.

Each of other channels is operated in the same manner as above by applying the drive pulse 400. The method for ejecting an ink drop is called DRR drive method, and a typical drive method of a sharing mode type record head.

(3-Cycle Driving)

When a record head 3 having a plurality of channels 31 compartmented by walls 32 composed of a piezoelectric material as an electromechanical conversion means as at least part thereof is driven, one wall 32 shared by adjacent channels 31, if both walls 32 of one channel 31 are bent and deformed during the operation of ejecting an ink drop, influences both adjacent channels 31. Thus, in the present invention, all channels 31 comprising a nozzle array are classified into a plurality of groups sandwiching the walls 32, with one group consisting of adjacent 3 channels 31, and 3-cycle driving is controlled so that operation of ejecting an ink drop of the channel 31 in each group is time-shared in series.

Figure 7:
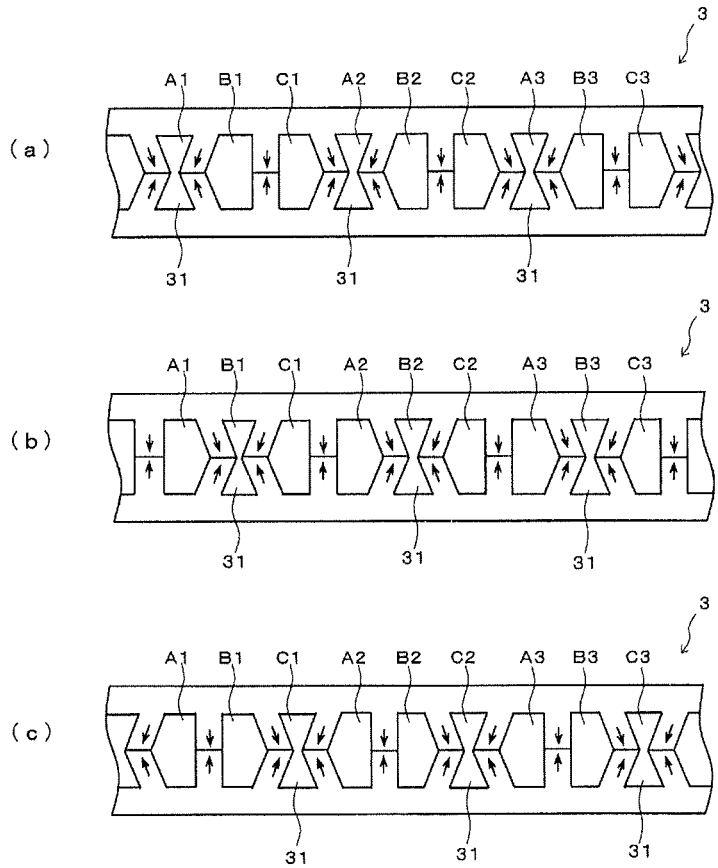
FIG. 7 is an explanatory diagram describing a 3-cycle driving method.
Figure 8:
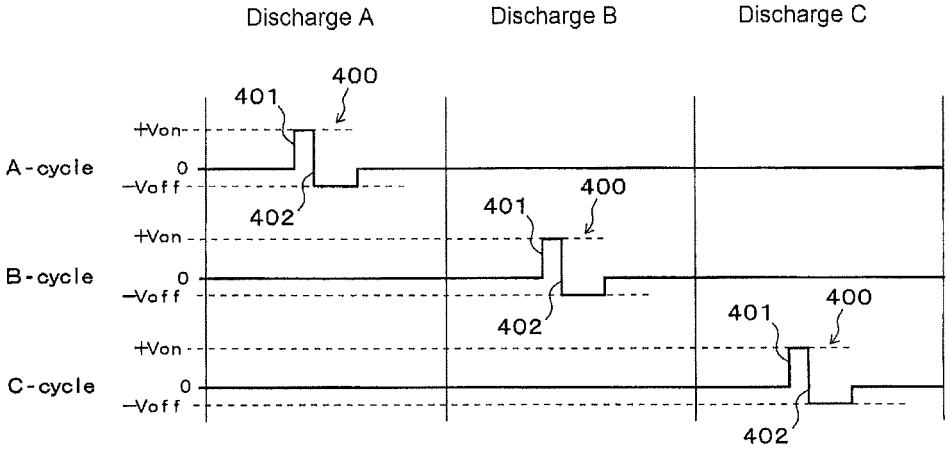
FIG. 8 is a figure showing one example of a timing chart of a drive pulse applied in a 3-cycle driving method.

The 3-cycle driving will be described in more detail with reference to FIGS. 7 and 8. An example shown in FIG. 7 exclusively describes 9 channels 31 classified into three groups arranged out of a plurality of channels 31: a group of A1, B1, C1, a group of A2, B2, C2 and a group of A3, B3, C3. FIG. 8 shows one example of a timing chart of a drive pulse applied to each channel 31 of A, B, C. Herein, the drive pulse 400, the same pulse as the one shown in FIG. 4 is used. FIG. 7 shows no nozzle.

When an ink drop is ejected, a voltage is applied to a drive electrode of a channel A (A1, A2, A3) in each group to ground drive electrodes of both adjacent channels B, C. When the first drive pulse 401 of a positive voltage is applied to the channel A, walls of the channel A to be ejected are externally bent and deformed to generate a negative pressure in the channel A. The negative pressure causes an ink to flow into the channel A (Draw).

1AL after this state is maintained to ground a drive electrode, deformed walls restore their shape to put a high pressure on an ink in the channel A (Release). Furthermore, when a second drive pulse 402 of a negative voltage is provided to the drive electrode of the channel A at the same time, the walls will deform toward the inside to put a higher pressure on the ink (Reinforce), extrude the ink from the nozzle and eject an ink drop. 2AL thereafter, when the drive electrode is grounded and the second drive pulse 402 is returned to zero potential, deformed walls will restore their shape to cancel a residual pressure wave.

When the channel A is driven, channels B, C adjacent thereto don't eject an ink drop. Subsequently, by driving a channel B (B1, B2, B3), and then a channel C(C1, C2, C3) in series in the above manner, an ink drop is ejected. Accordingly, all channels comprising a nozzle arrays can eject an ink drop, with no impact on the operation of ejecting by the adjacent channels.

Figure 9:
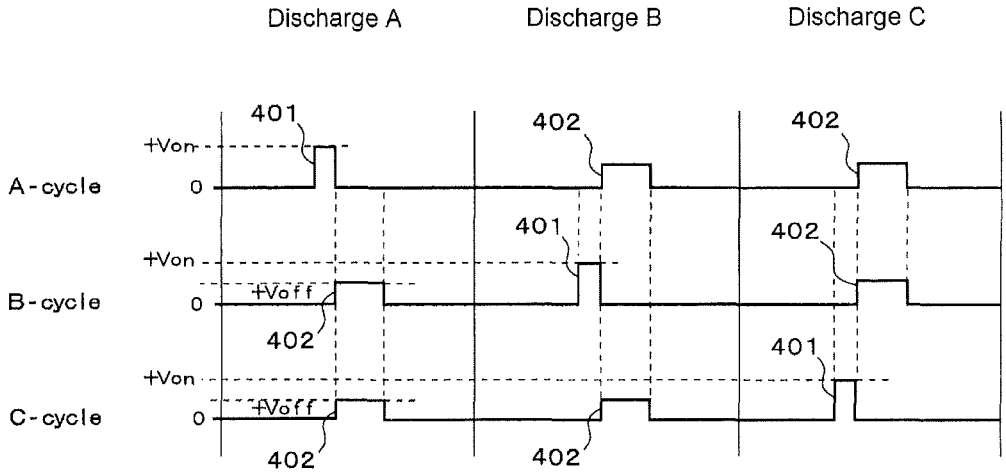
FIG. 9 is a figure showing another example of a timing chart of a drive pulse applied in a 3-cycle driving method.

The walls 32 are deformed by a difference in voltage on a drive electrode provided on both surfaces of the walls 32 in the sharing mode type record head 3. Thus, instead of giving a negative voltage to the drive electrode of the channel 31 that ejects an ink drop as the second drive pulse 402, the drive electrode of the channel 31 for ejecting an ink drop is grounded and a positive voltage is given to a drive electrode of its both adjacent channel 31 as the second drive pulse 402 to operate the record head 3 in the above manner only by the positive voltage, as shown in FIG. 9.

(Setting of Pressure on a Meniscus in Nozzles)

In the record head 3, as shown in FIG. 1, an ink is supplied from an ink supply portion 5. The ink supply portion 5 comprises a main tank 51 for storing an ink, ink supply tubes 52,53 for supplying the ink in the main tank 51 to the record head 3, a reversible liquid feed pump 54 inserted in the ink supply tube 52 for feeding a predetermined amount of an ink, a sub tank 55 inserted between the ink supply tubes 52,53 for temporarily storing the ink supplied from the main tank 51 and setting a pressure on a meniscus in the nozzle 34*a* of the record head 3 as a pressure-setting means, a liquid quantity detection apparatus 56 for detecting the amount of the ink in the sub tank 55, a pressure detection apparatus 57 for detecting the pressure in the sub tank 55, an atmosphere open valve 58 for opening the atmosphere in the sub tank 55, and an on-off valve 59 inserted in the ink supply tube 52 between the liquid feed pump 54 and the sub tank 55.

The ink in main tank 51 is supplied to the sub tank 55 via the ink supply tube 52 by driving the liquid feed pump 54. The sub tank 55 is designed to temporarily store a predetermined smaller amount of an ink than the main tank 51, and the ink is supplied to each of the channels 31 of the record head 3 via the ink supply tube 53 from the sub tank 55.

The sub tank 55 supplies an ink to the record head 3, and maintains the pressure on a meniscus in the nozzle 34*a* of the record head 3 at a specific negative pressure. In the present invention, the pressure on the meniscus in the nozzle 34*a* of the record head 5 set by the sub tank 55 is −20 cmAq or more and −5 cmAq or less.

If the pressure is −20 cmAq or more, no idling of nozzle caused by breaking of the meniscus formed on the nozzle surface and rolling air is generated to obtain a favorable ejection stability. If the pressure is −15 cmAq or more, the amount of an ink drop to be ejected can be sufficiently increased. If the pressure is −5 cmAq or less, extrusion of the meniscus in the nozzle 34*a* can be controlled when adjacent channels in a 3-cycle driving are driven to obtain a stable ejection property. Extrusion of the meniscus when adjacent channels in the 3-cycle driving are driven is particularly problematic in a pattern in which own channel is driven just after only adjacent channels are driven.

Figure 10:
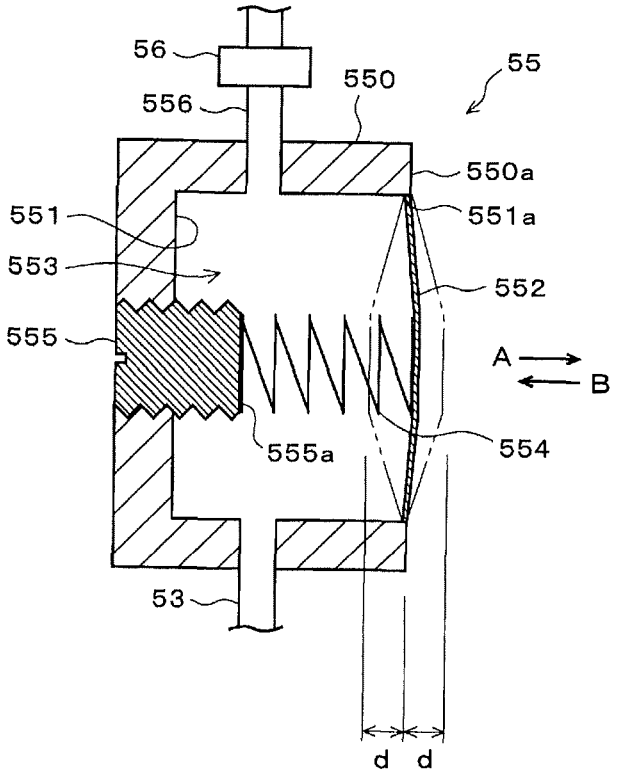
FIG. 10 is a cross sectional view showing one example of a sub tank capable of adjusting the pressure (back pressure) of a meniscus in nozzles.

FIG. 10 shows one example of a specific configuration of the sub tank 55 for setting the pressure on a meniscus in the nozzle 34*a* of record head 3.

In the sub tank 55, a concave portion 551 is formed on one face of a casing 550 formed in the form of a box from a corrosion-resistant material such as polypropylene and polyethylene. The concave portion 551 is provided with a recess on one face of the casing 550 so that an opening 551*a* is in a circular shape, and by covering the opening 551*a* with a resilient film 552, an internal space 553 for storing an ink by the resilient film 552 and the concave portion 551 is formed.

The internal space 553 comprises an elastic member 554 for applying a force from inside to outside of the concave portion 551 relative to the resilient film 552 as a biasing means for biasing the resilient film 552 in a direction of increasing the volume of the internal space 553 (in an arrow A direction in FIG. 10).

The elastic member 554 is inserted between the casing 550 and the resilient film 552 and abutted against one end portion perpendicular to the resilient film 552. In a coil spring shown herein, the elastic member 554 having a small change in force on the resilient film 552 by temperature change is preferable and not only a coil spring but also a spring member such as a plate spring formed in another form may be used. A biasing means other than a spring member may be used if it can apply a biasing force to the resilient film 552.

The resilient film 552 is a flexible film member, and can be an elastic material such as rubber, preferably a film composed of a polymer such as polyethylene terephthalate. Also it is preferably a composite film by laminating a plurality of materials in the form of a layer.

The resilient film 552 has an area that is slightly larger than an opening area of the opening 551*a*, and an outer circumferential edge thereof is secured to an inner circumference of the opening 551*a* or a surface of the casing 550 of the circumference of the opening 551*a* so that a film surface is loosened.

Therefore, the resilient film 552 is designed to be capable of protruding by a maximum of d (displacement+d) by applying a biasing force by the elastic member 554 in a biasing direction relative to a reference plane 550*a* defined by the surface of the casing 550 of the circumference of the opening 551*a*. When the pressure in the internal space 553 decreases, the resilient film 552 will move in a direction so as to decrease the volume of the internal space 553 against a biasing force of the elastic member 554 (in an arrow B direction in FIG. 10), and in this case, the resilient film 552 displaces by a maximum of d (displacement-d).

Normally, the position of the resilient film 552 is designed to come to the position of the reference plane 550*a*, and the resilient film 552 is biased by the elastic member 554 in a direction A to form a predetermined negative pressure. After its negative pressure is applied in each pressure-generating chamber of the record head 3 connected by the internal space 553 and the ink supply tube 53, the pressure (back pressure) on the meniscus in the nozzle 34*a* is set.

"555" denotes a biasing force adjusting screw for changing a biasing force relative to the resilient film 552 of the elastic member 554. The biasing force adjusting screw 555 penetrates in a wall surface of the casing 550 facing the opening 551*a*, and a tip end 555*a* is screwed to the casing 550 so that it is positioned in the internal space 553. Thus, the biasing force adjusting screw 555 is moved back and forth by backward/forward rotation from the outside of the casing 550 using a jig such as a screwdriver accordingly, and the position of tip end 555*a* is changed to change the biasing force of the elastic member 554 that biases the resilient film 552 between the tip end 555*a* and the resilient film 552 in an arrow A direction.

The pressure can be set by the sub tank 55 as follows.

The liquid feed pump 54 is subjected to forward rotation drive, with the atmosphere open valve 58 open, and an ink in the main tank 51 is fed to each pressure-generating chamber in the record head 3 via the sub tank 55 and the ink supply tube 53 to fill each pressure-generating chamber of the record head 3 from the sub tank 55 with a predetermined amount of an ink. Thereafter, the atmosphere open valve 58 is closed, and by backward rotation drive of the liquid feed pump 54 for a predetermined time, an ink is fed backward to the ink tank 51 from the sub tank 55 so that the pressure in the sub tank 55 detected by the pressure detection apparatus 57 and the pressure value on the meniscus in the nozzle 34*a* of the record head 3 are within the above ranges. Thereafter, by closing the on-off valve 59, a predetermined negative pressure formed by the sub tank 55 is applied to the record head 3, and the pressure (back pressure) in the meniscus in the nozzle 34*a* can be set within the above range.

The sub tank 55 is configured to be capable of setting the pressure (back pressure) in the meniscus in the nozzle 34*a* without particularly examining the height of the sub tank 55 arranged relative to the record head 3.

Figure 11:
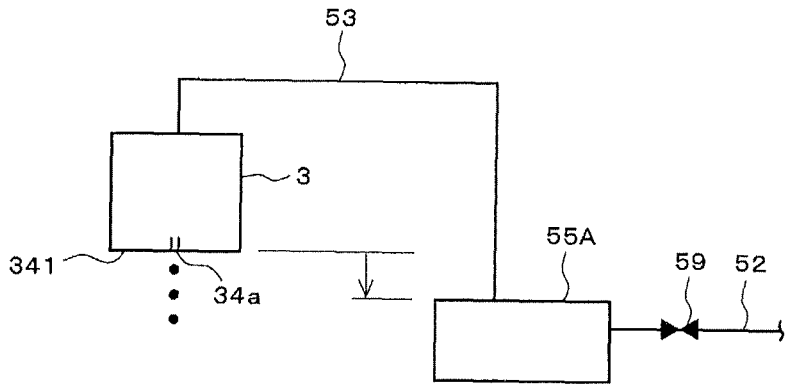
FIG. 11 is a cross sectional view showing another example of a sub tank capable of adjusting the pressure (hydraulic head pressure) of a meniscus in nozzles.

In addition, other means for setting the pressure on the meniscus in the nozzle 34*a* can be the one shown in FIG. 11. The same numbered elements as in FIG. 1 indicate the same components.

In this embodiment, the sub tank 55A is different from the sub tank 55 shown in FIG. 10, and is in the form of a common container having no function of generating a negative pressure in itself by a resilient film and an elastic member. The sub tank 55A is disposed at a lower position than the nozzle surface 341 of the record head 3.

Accordingly, the ink from main tank 51 (FIG. 1) is filled in each of the channels 31 of the record head 3, the ink supply tube 53 and the sub tank 55A via the ink supply tube 52. After closing the on-off valve 59, a predetermined pressure (hydraulic head pressure) is applied to the meniscus in the nozzle 34*a* of the record head 3 corresponding to the height of the sub tank 55A installed. Since the sub tank 55A is installed at a lower position than the nozzle surface 341 of the record head 3, the pressure is a negative pressure. Therefore, by adjusting the height of the sub tank 55A accordingly, the pressure (hydraulic head pressure) on the meniscus in the nozzle 34*a* can be set within the above range.

The sub tank 55A shown in FIG. 11 is provided so as to be capable of adjusting the height position in order to adjust variation in pressure as the flow rate declines by ink consumption.

(Pulse Width of Drive Pulse)

In the inkjet recording device 1 according to the present invention having the record head 3 in which the pressure on the meniscus in the nozzle 34*a* performs 3-cycle driving within a predetermined value range, a drive pulse for ejecting an ink drop applied to the walls 32, as shown in FIG. 4, is a drive pulse having a first drive pulse for generating a negative pressure in the channel 31 and a second drive pulse applied after applying the first drive pulse for generating a positive pressure in the channel 31. A pulse width W1 of the first drive pulse for generating a negative pressure in the channel 31 is set in a range of $1.4AL \leq W1 \leq 1.8AL$.

The application of the first pressure wave in the channel 31 is completed 1AL slightly after its conversion from the negative pressure to the positive pressure. Subsequently, the second drive pulse for generating a positive pressure in the channel is applied. By putting the pulse width W1 within the above range on condition that the pressure on the meniscus in the nozzle 34*a* is −20 cmAq or more and −5 cmAq or less, the flow rate of an ink drop ejected from the nozzle 34*a* can be increased and the dot diameter can be widened without deteriorating ejection stability by a significant increase in drive voltage of the first drive pulse.

As shown in a later-described Example, on a drive condition for obtaining a predetermined droplet speed (e.g. 6 m/s), if the pulse width W1 is under 1.4AL, an increase in the flow rate of an ink drop cannot sufficiently be obtained, compared to a case where a first drive pulse having a conventional 1AL width is applied even if the pressure on the meniscus in the nozzle 34*a* satisfies the range (−20 cmAq or more and −5 cmAq or less). If the pulse width W1 is 1.8AL or more, an ink drop cannot be ejected with a predetermined droplet speed without significantly increasing the drive voltage of the first drive pulse, thereby reducing ejection stability from the impact of cross talk.

Figure 12:
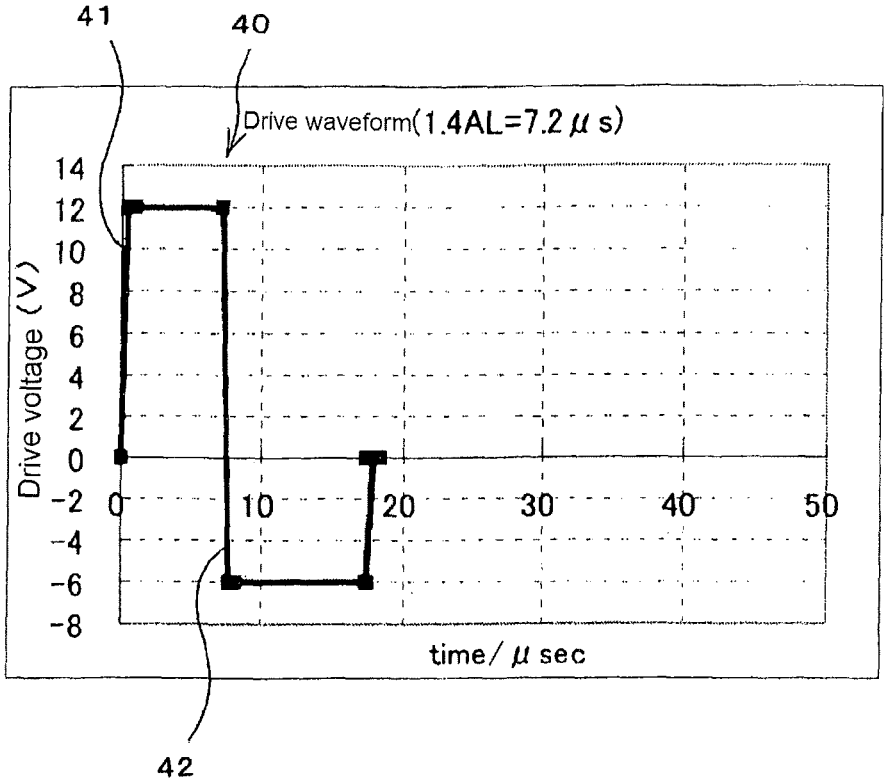
FIG. 12 is a figure showing one example of a drive pulse when the pulse width of a first drive pulse used in the present invention is set at 1.4AL.
Figure 13:
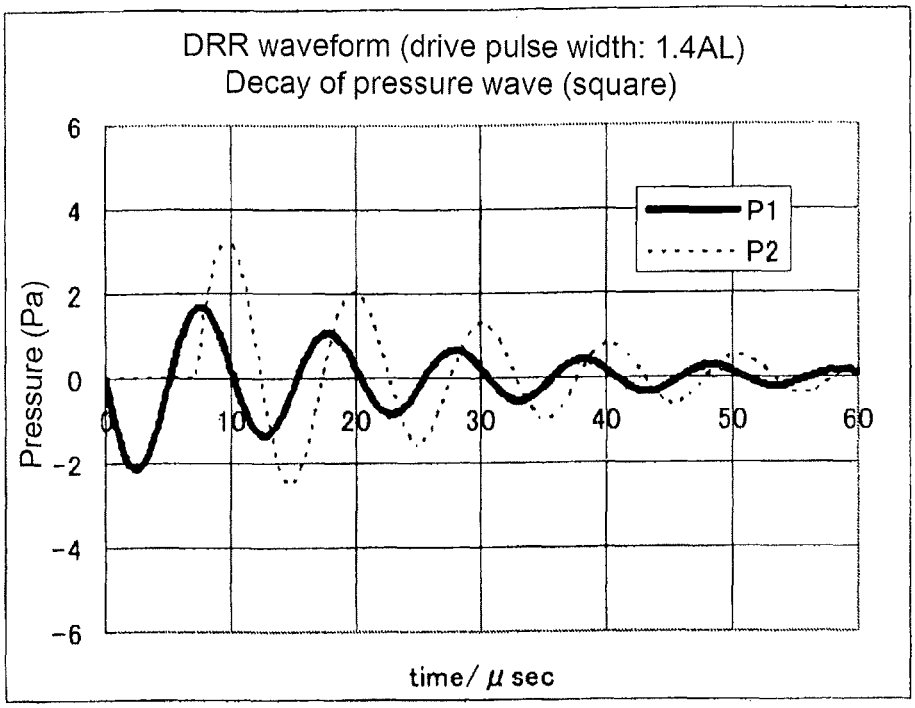
FIG. 13 is a graph showing pressure waves P1 and P2 in a channel when a drive pulse shown in FIG. 12 is applied thereto.
Figure 14:
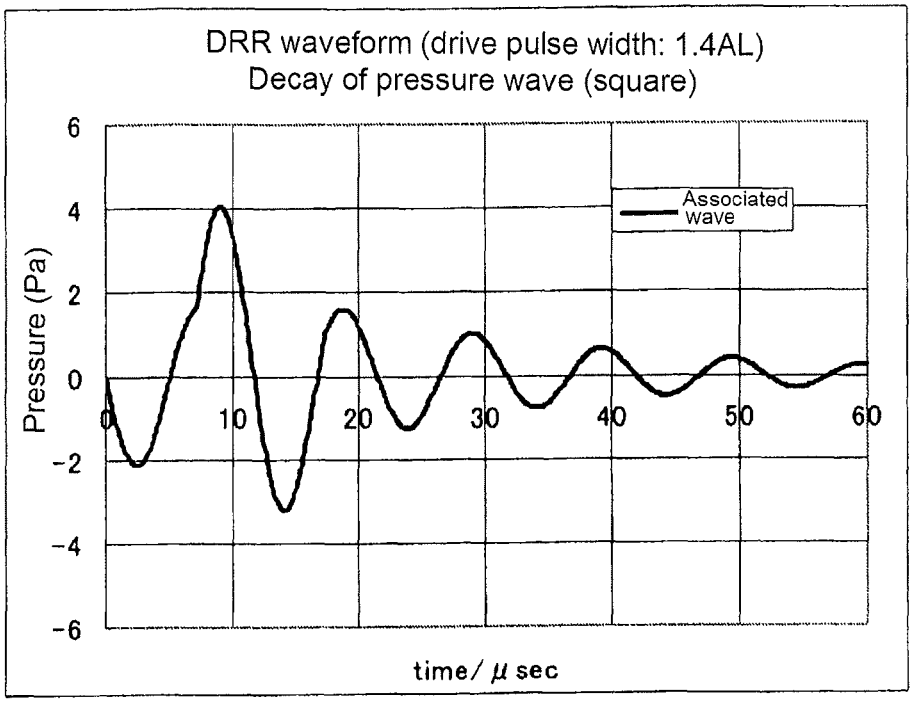
FIG. 14 is a graph showing an associated wave of pressure waves P1 and P2 in a channel when a drive pulse shown in FIG. 12 is applied thereto.

FIG. 12 shows a drive pulse 40 composed of a square wave when the pulse width W1 of first drive pulse is set at 1.4AL, and FIGS. 13 and 14 show a time change in a pressure generated in the channel by the drive pulse 40. By using a standard of 1AL=5.1 μs like the drive pulse 400 shown in FIG. 4, 1.4AL=7.2 μs.

The drive pulse 40 is a square wave comprising a first drive pulse 41 composed of a positive voltage (+Von=+12V) for generating a negative pressure in the channel 31 like a conventional drive pulse 400 shown in FIG. 4 and a second drive pulse 42 composed of a negative voltage (−Voff=−6V) for generating a positive pressure in the channel 31 applied 1.4AL after maintaining the first drive pulse 41.

2AL after maintaining the second drive pulse 42, the pulse width W2 of the second drive pulse 42 is returned to zero potential. By setting the pulse width W2 of the second drive pulse 42 at 2AL, a residual pressure wave can be canceled in the channel 31 after ejecting an ink drop by applying the second drive pulse 42. By canceling the residual pressure wave, a meniscus vibration in the nozzle 34*a* can be canceled, thereby further improving ejection stability.

1.4AL after maintaining the first drive pulse 41 to apply the second drive pulse 42, the first pressure wave P1 in the channel 31 is converted from a negative pressure to a positive pressure after applying the first drive pulse 41. While the meniscus in the nozzle 34*a* moves in a direction of ejection by a pressure given on an ink in the channel 31 by the positive pressure, the second pressure wave P2 generated by the second drive pulse 42 is applied. Accordingly, a time integral value of a pressure generated in the channel 31 increases, thereby increasing the flow rate of an ink drop ejected from the nozzle 34*a*. As shown in FIG. 14, the peak value of the positive pressure by superposing pressure waves declines compared to the peak value shown in FIG. 6, thereby slightly reducing discharge efficiency.

Figure 15:
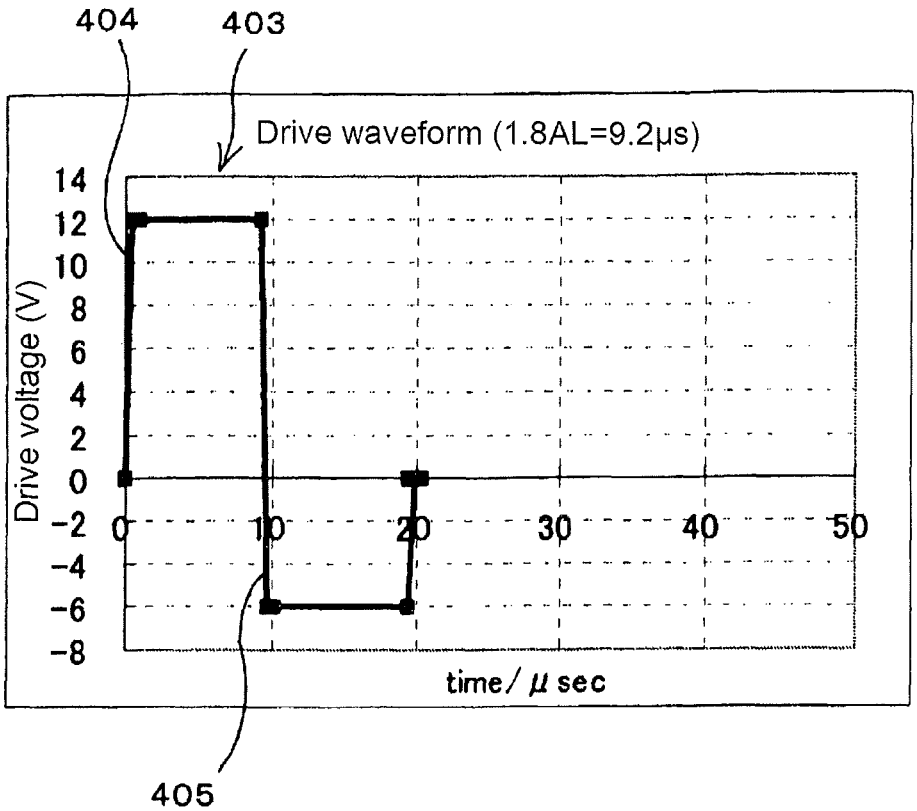
FIG. 15 is a figure showing one example of a drive pulse when the pulse width of a first drive pulse irrelevant of the present invention is set at 1.8AL.
Figure 16:
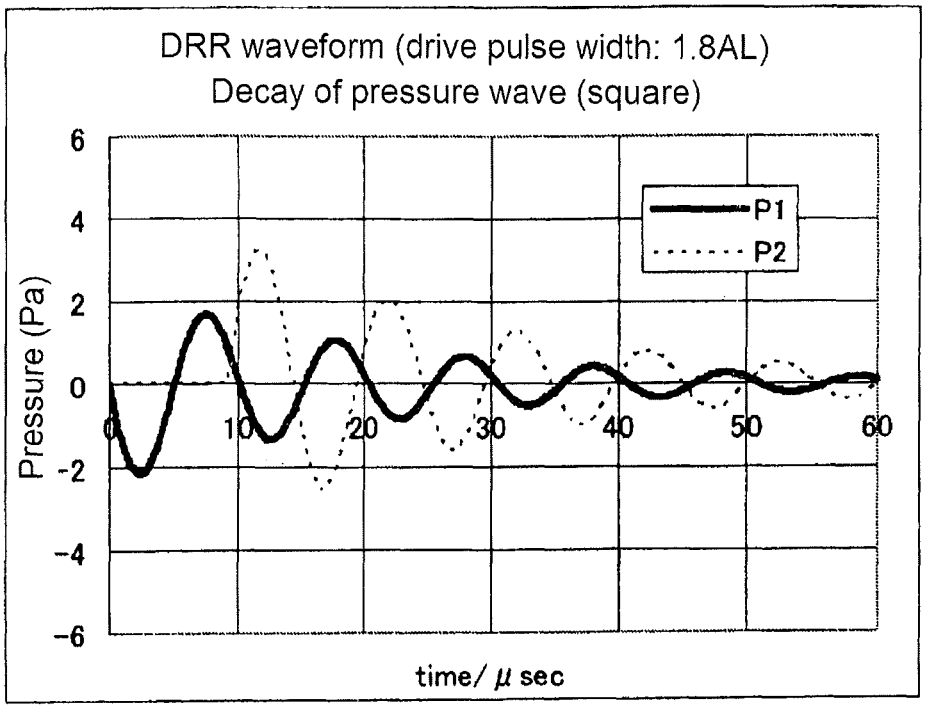
FIG. 16 is a graph showing pressure waves P1 and P2 in a channel when a drive pulse shown in FIG. 15 is applied thereto.
Figure 17:
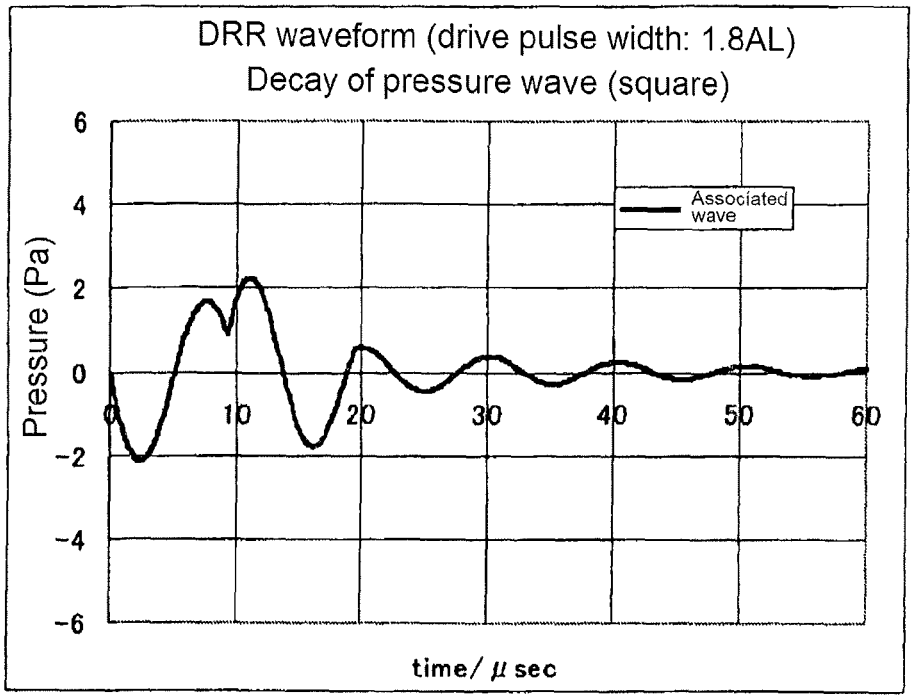
FIG. 17 is a graph showing an associated wave of pressure waves P1 and P2 in a channel when a drive pulse shown in FIG. 15 is applied thereto.

Next, as a comparison, FIG. 15 shows a drive pulse 403 by setting the pulse width W1 of the first drive pulse at 1.8AL (irrelevant of the present invention). FIGS. 16 and 17 show a time change in a pressure generated in the channel by the drive pulse 403. By using a standard of 1AL=5.1 μs like the drive pulse 400 shown in FIG. 5, 18AL=9.2 μs.

The drive pulse 403, like a conventional drive pulse 400 shown in FIG. 4, is a square wave comprising the first drive pulse 404 composed of a positive voltage (+Von=+12V) and the second drive pulse 405 composed of a negative voltage (−Voff=−6V) applied 1.8AL after maintaining the first drive pulse 404. The pulse width W2 of the second drive pulse 405 is returned to zero potential 2AL after maintaining the second drive pulse 405.

Accordingly, if the pulse width W1 of the first drive pulse 404 is 1.8AL, the peak value of a positive pressure by superposing the first pressure wave P1 generated by application of the first drive pulse 404 and the second pressure wave P2 by application of the second drive pulse 405, as shown in FIG. 16, significantly declines, thereby significantly reducing discharge efficiency. Thus, unless the drive voltage of the first drive pulse is significantly increased, an ink drop cannot be ejected from the nozzle 34*a* at a predetermined droplet speed.

Inventors of the present invention confirmed that the speed of ejecting an ink drop gradually declines as the pulse width W1 of first drive pulse is increased from 1.4AL to 1.8AL on condition that the drive voltage of the first and second drive pulses is constant. If the speed of ejecting an ink drop is 1.4AL or more and under 1.8AL, the objective of the present invention is fulfilled. However, if the value is 1.8AL or more, whether the pressure on the meniscus in the nozzle 34*a* fulfills the condition of −20 cmAq or more and −5 cmAq or less or not, an ink drop cannot be ejected from the nozzle 34*a* at a predetermined droplet speed unless the drive voltage of the first drive pulse is significantly increased in the above manner, thereby reducing ejection stability due to the impact of cross talk.

In the present invention, a preferred embodiment is to use the above described square wave as the drive pulse 40 composed of the first drive pulse 41 and the second drive pulse 42. Since the sharing mode type record head ejects an ink drop from the nozzles by using resonance of a pressure generated in the channel wave, an ink drop can be more efficiently discharged by using the square wave.

Since a meniscus swiftly responds to application of a drive pulse composed of a square wave in the sharing mode type record head, it is possible to reduce the drive voltage. Since a voltage is always applied to a record head (both ejection and non-ejection), a low drive voltage is important to control heat generation of a head and stably eject an ink drop.

Moreover, since the square wave can readily be produced by using a simple digital circuit, it is more advantageous to simplify a circuitry than a trapezoidal wave having a sloping wave.

The inkjet recording device 1 according to the present invention ejects an ink containing a pigment supplied from the ink supply portion 5 by the drive pulse 40 to the recording material P by 3-cycle driving method, with the pulse width W1 of the first drive pulse 41 within a predetermined range, while the pressure on the meniscus in the nozzle 34*a* of the above record head 3 is set within a predetermined range. Thereafter, even when the second drive pulse for generating a positive pressure in the pressure-generating chamber after the first drive pulse is applied, a reduction in drive frequency is controlled. While ejection stability is maintained when applied to 3-cycle driving, the flow rate of an ink drop is increased, compared to a conventional drive waveform whose pulse width W1 of first drive pulse is 1AL, to widen the dot diameter, and a high-quality inkjet image whose generation of a void and a white stripe is reduced can be recorded and formed.

(Speed of an Ink Drop)

As described above, the inkjet recording device 1 according to the present invention can obtain effects of controlling a reduction in drive frequency and increasing the flow rate of an ink drop while maintaining ejection stability with the inkjet recording device applied to 3-cycle driving. However, in the present invention, the speed of an ink drop after 0.5 mm flight from the nozzle 34*a* is preferably set at 6 m/s or more and 8 m/s or less. If the speed of an ink drop is 6 m/s or more, impact position displacement, when an image is recorded, can be reduced, and if the speed is 8 m/s or less, generation of a satellite, when an ink drop is ejected, can be reduced to control unfavorable ejection from the satellite.

The speed of an ink drop after 0.5 mm flight from the nozzle 34*a* is the speed calculated by a duration from the start of application of the first drive pulse 41 to arrival of an ink drop at the position 0.5 mm perpendicular to the nozzle surface.

To put the speed of an ink drop within the above range, the drive voltage value of the first drive pulse 40 may be adjusted accordingly. The voltage value is adjusted to reduce impact position displacement and unfavorable ejection in the above manner, not to increase the flow rate of an ink drop. The objective of increasing the flow rate of an ink drop is fulfilled by setting conditions of the pulse width W1 of the first drive pulse 41 and pressure on the meniscus in the nozzle 34*a* as described above. According to a later described Example, even if the drive voltage value of the first drive pulse 40 is adjusted accordingly so as to put the speed of an ink drop within the above range, it is not necessary to significantly increase the drive voltage of the first drive pulse, and discharge stability in 3-cycle driving is maintained.

Figure 18:
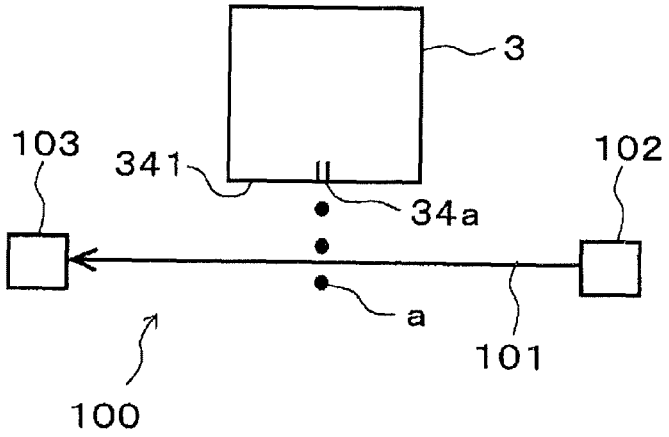
FIG. 18 is an explanatory diagram describing how to detect the speed of an ink drop.

The speed of an ink drop can be detected, as shown in FIG. 18, by using a light emitting element 102 for emitting a detection light 101 such as an LED and a laser and a light receiving element 103 composed of a photodiode and so on for receiving the detection light 101 emitted from the light emitting element 102 that is disposed opposite to the light emitting element 102, and a velocity detector 100 in which the detection light 101 is arranged in parallel with a nozzle surface 341 so that the ink drop "a" ejected from the nozzle 34*a* crosses the detection light 101. When the ink drop "a" passes the detection light 101, the amount of a detection light of the light receiving element 103 declines to detect the passing of the ink drop "a". Therefore, by disposing an optical axis of the detection light 101 so as to come to a 0.5 mm position in a direction perpendicular to the nozzle surface 341, the duration from the start of application of the first drive pulse 41 to passing of an ink drop "a" through the detection light 101 can be detected and the speed of an ink drop "a" after 0.5 mm flight from the nozzle surface 341 can readily be obtained.

In addition, the speed of an ink drop after 0.5 mm flight from the nozzle 34*a* may be obtained by arithmetic operation after calculating the speed of an ink drop by imaging an ink drop ejected from the nozzle 34*a* and image-processing the image of the ink drop.

The speed of an ink drop is measured beforehand upon factory shipment of the inkjet recording device 1, and the drive voltage value of the first drive pulse can be adjusted accordingly so as to put the speed within the above range based on the measurement. Also, after the inkjet recording device 1 is installed and operated, the speed of an ink drop may be measured and adjusted by using the velocity detector 100 installed in the inkjet recording device 1 when the record head 3 and others are subjected to maintenance operation.

(Microoscillation Pulse)

In the inkjet recording device 1 according to the present invention, the drive pulse generating portion 4 records and operates an image on a recording material P by applying the drive pulse 40 composed of the first drive pulse 41 and the second drive pulse 42 shown in FIG. 12 to a drive electrode formed on the walls 32 of the channel 31 for ejecting an ink drop from the nozzle 34*a*. Preferably, the first drive pulse 41 is not applied to a drive electrode formed on both walls 32 of a channel 31 for ejecting no ink drop from the nozzle 34*a* having no image data during image recording and operating, or of a channel 31 involved in no image recording, and only the second drive pulse 42 is applied thereto.

Figure 19:
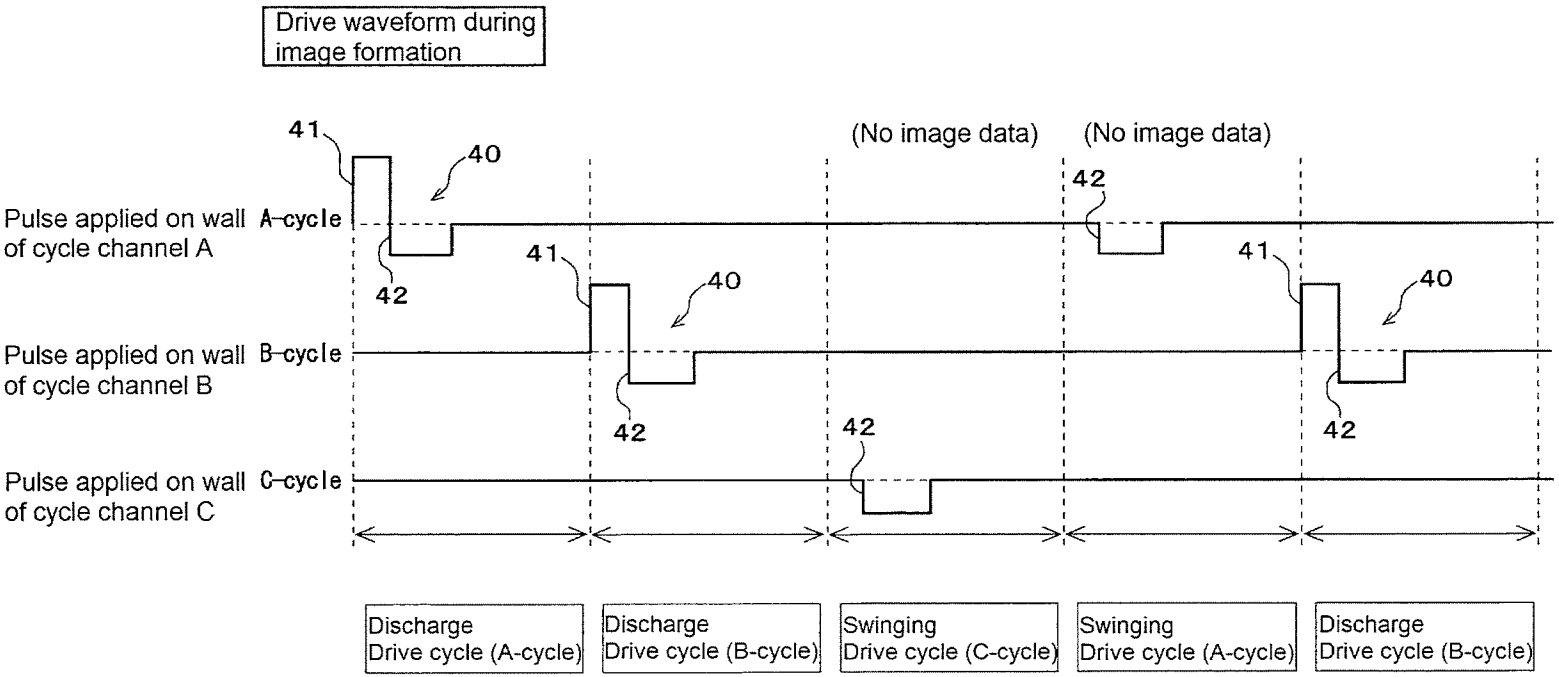
FIG. 19 is a figure showing one example of a timing chart when a microoscillation pulse is applied during image recording operation.

FIG. 19 shows one example of a timing chart when the pulse is applied. As shown in the figure, the channel 31 involved in no image recording is present in each of drive cycles A, B, C, the first drive pulse 41 is not applied and only the second drive pulse 42 is applied in the drive cycle of the channel 31.

In this manner, if only the second drive pulse 42 is applied to a drive electrode of the channel 31 involved in no image recording during image recording, the drive voltage value of the second drive pulse 42 is small at one half of the drive voltage value of the first drive pulse 41. The second drive pulse 42 functions as a microoscillation pulse, and a microoscillation ("swinging") is applied to the meniscus in the nozzle 34*a* corresponding to the channel 31 so that an ink drop is not ejected. Accordingly, an ink in the nozzle 34*a* and proximity thereof is agitated and thickening by dry condition can be reduced. Thus, preferably, an ink drop can more stably be discharged.

In this embodiment, the drive voltage value of the second drive pulse 42 is set at one half of the drive voltage value of the first drive pulse 41, but it is not restricted thereto. Preferably, the drive voltage value of the second drive pulse 42 is made smaller than the drive voltage value of the first drive pulse 41 so that the second drive pulse functions as a micro oscillation pulse.

The second drive pulse 42 only can be applied during image recording standby as well. The image recording standby means a period that allows an inkjet recording device to operate but an image recording to temporarily halt, such as a period in which an ink drop between one image and another or a sheet-like recording material and a recording material are not ejected, a period for temporary interruption of recording operation by replacement of a recording material or a jam, and a period for maintaining a record head.

Figure 20:
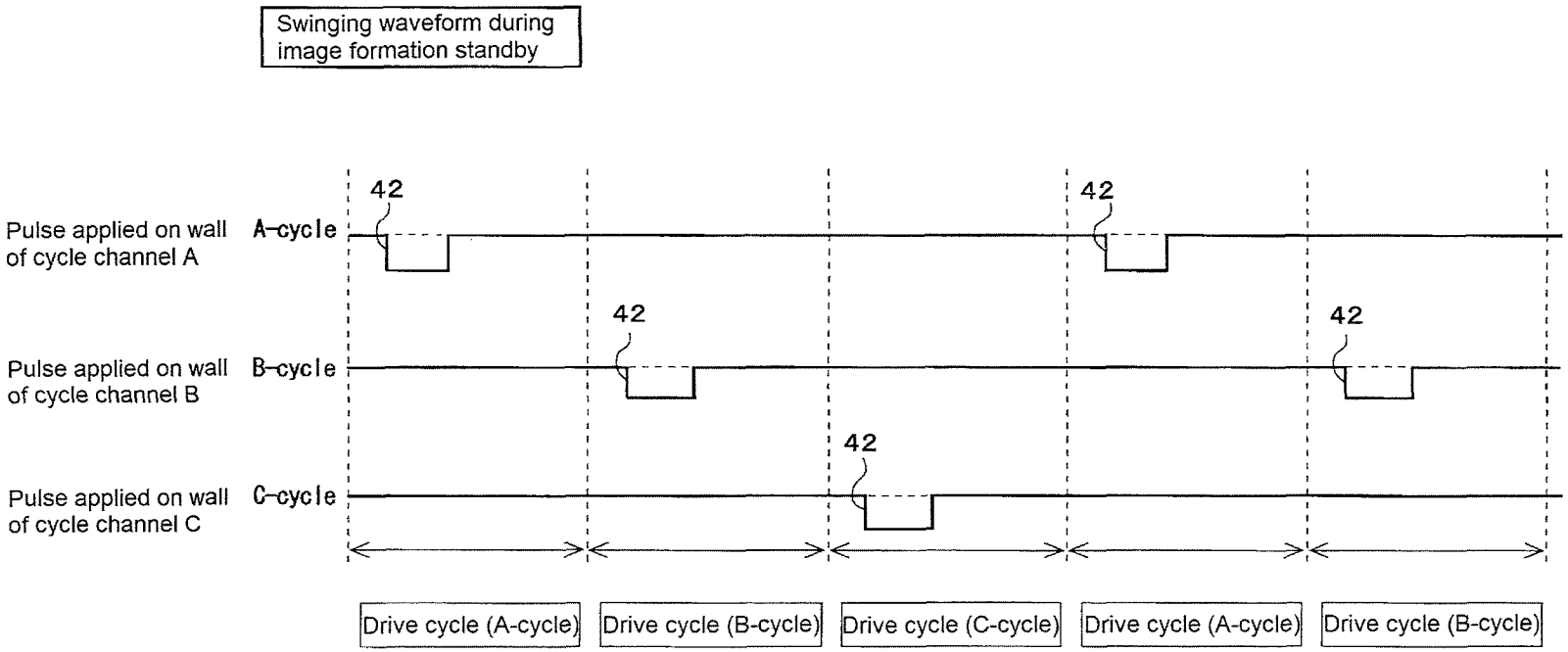
FIG. 20 is a figure showing one example of a timing chart when a micro oscillation pulse is applied during image recording standby.

During standby of the image recording, as shown in FIG. 20, only the second drive pulse 42 is applied to all channels 31 in each of drive cycles A, B and C. since the drive voltage value of the second drive pulse 42 is small at one half of the drive voltage value of the first drive pulse 41, the meniscus in the nozzle 34*a* corresponding to the channel 31 is subjected to microoscillation so as not to eject an ink drop. Preferably, the ink in the nozzle 34*a* and proximity thereof is agitated and its thickening can be reduced by dry condition, and an ink drop can more stably be discharged.

In addition, when image recording starts again, only the first drive pulse 41 is added to a drive electrode of both walls 32 of the channel 31 for ejecting an ink drop to readily generate and apply the drive pulse 40, so that a terminal end of the first drive pulse 41 is connected with a beginning end of the second drive pulse 42.

(Inkjet Recording Method)

The inkjet recording method according to the present invention records and forms an inkjet image on the recording material P, using the inkjet recording device 1.

As a recording material P, an absorptive recording material using an absorptive support having a high ink absorbability such as regular paper and fine paper can obviously be used. In the inkjet recording method according to the present invention, a non-absorbable recording material or a slightly absorbable recording material is particularly preferably used. The non-absorbable recording material or the slightly absorbable recording material is a recording material having a poor ink absorptivity, thereby failing to increase the diameter of a dot landed and thus readily generate a void or a white stripe at a solid portion. Thus, by using the non-absorbable recording material or the slightly absorbable recording material in the inkjet recording device 1, an image whose dot diameter is widened from an increase in flow rate of an ink drop can more obviously be recorded and formed.

A non-absorbable recording material is a recording material using a non-absorbable support composed of a non- or hardly water absorbable hydrophobic resin as a support, e.g. a recording material formed by a resin film such as a polyester film, a polyolefin film, a polyvinylchloride film and a polyvinylidene chloride film. In addition, a resin-coated paper as a printing paper for photographs and a Yupo paper as a synthetic paper can be used.

A slightly absorbable recording material is a recording material that absorbs water to some extent as a support, compared to a non-absorbable recording material, using a slightly absorbable support whose absorption speed is low and whose aqueous ink is disadvantageously not dried in an environment of normal room temperature and humidity, e.g. a recording material formed by an art paper and a coated paper.

A recording material for an inkjet is obtained by forming an ink receiving layer on a surface of a base material using the above absorptive support, preferably a non-absorbable support or a slightly absorbable support. Illustrative example of the ink receiving layer comprises a coat layer, a swelling layer and a microvoid layer.

A swelling layer absorbs an ink after an ink receiving layer composed of a water-soluble polymer swells. A microvoid layer is composed of an inorganic or an organic fine particle and a binder whose secondary particle diameter is 20 to 200 nm to cause a fine void (100 nm or so) to absorb an ink.

When an image is recorded on the recording material P, the flow rate of an ink drop ejected corresponding to the ink absorption speed of the recording material P used is preferably adjusted. In comparison of a recording material having a relatively high ink absorption speed and a recording material having a low ink absorption speed, by making the dot diameter of the recording material having a high ink absorption speed relatively smaller and making the dot diameter of the recording material having a low ink absorption speed relatively larger, regardless of the extent of the ink absorption speed of the recording material P used, a high-quality image having no void or white stripe can be recorded and formed.

The ink absorption speed of the recording material P can be measured by Bristow method. Using Bristow method, the liquid transition level can be measured with Bristow Tester in accordance with JAPAN TAPPIUM405. The inkjet recording method according to the present invention can particularly preferably applied when an image is recorded and formed using a low absorptive recording material whose ink absorption speed is 10 ml/(mm2·s) or less.

The flow rate of an ink drop to be ejected can be adjusted by adjusting the pressure on the meniscus in the nozzle 34*a* and the pulse width W1 of the first drive pulse 41 within the above described ranges, respectively.

(Aqueous Ink)

An aqueous ink can preferably be used as an ink containing a pigment used in the present invention. Preferred example of the aqueous ink includes an aqueous inkjet ink containing at least water, a pigment, a water-soluble resin, a water-soluble organic solvent, and a surfactant.

Preferred one example of the aqueous inkjet ink includes a water-soluble resin whose acid number is 50 mgKOH/g or more and 130 mgKOH/g or less, whose glass transition temperature (Tg) is 30° C. or more and 100° C. or less, and whose weight average molecular weight (Mw) is 20,000 or more and 80,000 or less, a copolymer resin synthesized from a monomer containing at least methyl methacrylate, alkyl acrylate or alkyl methacrylate, and an acid monomer as a monomer, and a water-soluble resin whose total mass of methyl methacrylate, alkyl acrylate and alkyl methacrylate is 80% or more and 95% or less relative to mass of all the monomers comprising the copolymer resin, wherein a surfactant contains at least a fluorochemical surfactant and polyoxyethylene alkyl ether.

An image formed on the recording material P using the ink has a high wear resistance and adhesive property, and a high-quality image having no repellency or void can be recorded and formed. In particular, even if the recording material P is non-absorbable or slightly absorbable, the record head 3 can be expected to increase the flow rate of an ink drop ejected therefrom and carry out a favorable image recording.

The inkjet recording device and the method for recording an image according to the present invention are preferable when an aqueous ink is used as the ink in particular to significantly provide effects of the present invention. Specifically, an aqueous ink is generally high in volume elastic modulus. Therefore, when a pressure-generating chamber is driven, extrusion of a meniscus from the nozzles of adjacent non-driven pressure-generating chambers can grow, because the impact of cross talk is found larger. Herein, an aqueous ink is defined as the one whose water content relative to the total mass is 10% by mass or more.

The aqueous ink will be described in more detail.

A copolymer resin functions as a binder (fixing resin) of a pigment as a colorant, and has adhesive property with a non-absorbable recording material and a slightly absorbable recording material, and wear resistance of a coating film is improved thereby.

In addition, the copolymer resin requires a function of forming a significantly glossy image having a high optical concentration, thereby providing the copolymer resin in itself with a high transparency in a coating film and compatibility with a pigment or a pigment dispersion resin.

An ink wettability with a recording material is also an important property to provide a non-absorbable recording material and a slightly absorbable recording material with a high-quality and durable printed image, and a wetter ink with a non-absorbable recording material and a slightly absorbable recording material shows a higher image quality and a higher image durability. Accordingly, as a resin to be added to an ink, ink wettability with a non-absorbable recording material and a slightly absorbable recording material is not preferably deteriorated.

An ink to which a copolymer resin of alkyl acrylate or a methacrylic alkyl ester having a low acid number in particular, whose total mass with methyl methacrylate, alkyl acrylate and alkyl methacrylate is 80% or more and 95% or less relative to the mass of all the monomers comprising the copolymer resin, is added, shows a favorable wear resistance.

An acrylic resin by copolymerizing acrylic ester and methacrylate ester as a monomer can be selected and designed from extremely various types of monomers as commonly known, which can readily be polymerized, and produced with a low cost, and thus is appropriate in the present invention. In particular, an acrylic resin having great design flexibility is desirable to fulfill many requirements when an ink is added.

Commercially available acrylic resins include a water dispersible acrylic emulsion and a water-soluble resin. An emulsion-type resin is generally higher in molecular weight than a water-soluble resin and can increase film strength made by a resin, while a dried film doesn't dissolve in water. Therefore, once a resin is dried on a head, the film cannot be dissolved and removed, but it must be scraped to be removed and maintenance operation is required. Thus, a copolymer resin used is a water-soluble resin.

In a water-soluble resin, a copolymer resin after a later-described neutralization may be dissolved in water at 25° C.

(over 2% by mass), preferably (2% by mass or more) may be dissolved in water at 25° C., more preferably (10% by mass or more).

A copolymer resin has an acid number of 50 mgKOH/g or more and 130 mgKOH/g or less.

Inventors of the present invention carried out extended research on various types of water-soluble resins to find that acid number, wear resistance and adhesive property of the copolymer resin show a close relationship and as the acid number of the copolymer resin declines, wear resistance and adhesive property are improved. According to inventors of the present invention, as the acid number of the copolymer resin becomes higher, resin's hydrophilic property will be high, and the affinity with a hydrophobic base material becomes lower, and a resin and a base material are not readily bonded. Conversely, if the acid number is low, the resin is hydrophobic, the affinity with the hydrophobic base material becomes higher and the resin and the base material are favorably bonded.

Also, the acid number of the copolymer resin is associated with resin's water-solubility, ejection property of an ink and maintenance property. As the acid number is high, resin's water-solubility becomes high and the resin can readily be dissolved. When an ink is dried on a head, it can readily be dissolved and removed, thereby easily scraping the ink for easy maintenance. Conversely, the acid number of the copolymer resin influences the glossy property, and a lower acid number tends to improve the glossy property.

As described above, the acid number of the copolymer resin is preferably 50 mgKOH/g or more and 130 mgKOH/g or less, more preferably 50 mgKOH/g or more and 100 mgKOH/g or less.

The acid number means the number of milligrams of potassium hydroxide required for neutralization of an acid present in a resin (1 g), or the amount of an acidic polar group present in a molecular terminal. As the acid number is high, an acid group such as a carboxyl group is found in large quantities.

The acid number can be measured by a method in accordance with ITS K0070.

In the copolymer resin, the glass transition temperature (Tg) is 30° C. or more and 100° C. or less. When Tg is 30° C. or more, the wear resistance is high and no blocking is generated. Also, when Tg is 100° C. or less, the wear resistance is favorable. This is possibly because the film is subjected to room temperature after drying and it keeps flexibility, not brittleness. Tg of the copolymer resin can be adjusted according to the type and composition ratio of a copolymerized monomer.

The weight average molecular weight (Mw) of a copolymer resin is 20,000 or more and 80,000 or less. If the weight average molecular weight is 20,000 or more, the wear resistance is favorable and if it is 80,000 or more, ink ejection property and maintenance property are excellent. More preferably, the weight average molecular weight of the copolymer resin is 25,000 or more and 70,000 or less.

The weight average molecular weight of the copolymer resin can be adjusted by reaction conditions such as monomer concentration under polymerization and the amount of an initiator. For instance, by increasing the monomer concentration, the weight average molecular weight can be increased, and by increasing the amount of an initiator, the weight average molecular weight can be decreased.

As a copolymerizing monomer comprising a copolymer resin, at least methyl methacrylate, alkyl acrylate or alkyl methacrylate, and acid monomer should be contained to improve wear resistance and adhesive property of an image.

Inventors of the present invention carried out extended research to find that with many carbon atoms in an alkyl group of alkyl acrylate or alkyl methacrylate, an acid monomer is an acrylic acid or a methacrylic acid, and by increasing the copolymerization ratio of methyl methacrylate, alkyl acrylate or alkyl methacrylate, wear resistance and adhesive property on a non-absorbable recording material of a water-soluble resin and slightly absorbable recording material tend to be high. This is possibly because as a water-soluble resin is more hydrophobic, wear resistance and adhesive property on a non-absorbable recording material and a slightly absorbable recording material increase.

The ink repellent property obtained by an ink repellent treatment of a record head tends to be favorable with smaller carbon atoms of an alkyl group of alkyl acrylate or alkyl methacrylate, and if the number of carbon atoms of an alkyl group of alkyl acrylate or alkyl methacrylate is 8 or less, impact of deterioration on ink repellent property is preferably small.

Accordingly, in order to assure wear resistance, adhesive property and ink repellent property at the same time, alkyl acrylate or alkyl methacrylate having 2 to 8 carbon atoms of methyl methacrylate and alkyl group is preferably copolymerized with a favorable ink repellent property.

Illustrative example of the alkyl acrylate or the alkyl methacrylate having 2 to 8 carbon atoms of said alkyl group includes acrylic acid(methacrylic acid) ethyl, acrylic acid (methacrylic acid)n-butyl, acrylic acid(methacrylic acid)i-butyl, acrylic acid(methacrylic acid)t-butyl, acrylic acid (methacrylic acid)n-hexyl, acrylic acid(methacrylic acid) cyclohexyl, acrylic acid(methacrylic acid)octyl, and acrylic acid(methacrylic acid)2-ethylhexyl.

As to the copolymerization ratio of alkyl acrylate or alkyl methacrylate having 2 to 8 carbon atoms of alkyl group relative to all monomers of a copolymer resin, its mass ratio is preferably 5% by mass or more in terms of wear resistance and adhesive property, and 50% by mass or less in terms of ink repellent property obtained by ink repellent treatment of ink-jet head, more preferably 5% by mass or more and 40% by mass or less.

The methyl methacrylate is preferably added by 15 to 85% by mass, more preferably 40 to 80% by mass relative to all the monomers as a raw material of the copolymer resin.

Moreover, the total mass of methyl methacrylate, alkyl acrylate and alkyl methacrylate should be 80% or more and 95% or less relative to the mass of all the monomers comprising a copolymer resin in terms of wear resistance and adhesive property.

Illustrative example of the acid monomer includes acrylic acid, methacrylic acid, itaconic acid, maleic acid, and maleic acid half ester. Among other things, acrylic acid and methacrylic acid are preferable, because they have a high ejection stability and a favorable maintenance property.

Illustrative example of the copolymerized monomer as a copolymer resin includes said methyl methacrylate, alkyl acrylate and alkyl methacrylate, acid monomer, and other monomers such as styrene so long as they don't deteriorate wear resistance, ink repellent property, and maintenance property.

The copolymer resin may be added before or after dispersing a pigment, but preferably after dispersing a pigment. The mass ratio of a copolymer resin relative to a pigment is preferably a single or more and 20 times or less.

The copolymer resin is preferably added in an ink by 1% to 20% by mass, more preferably 3% to 15% by mass.

In a copolymer resin, if the mass ratio relative to a solid pigment is a single or more, favorable image wear resistance, adhesive property and gloss can be obtained. If the mass ratio is 20 times or less, ink ejection property and maintenance property are not preferably deteriorated. More preferably, the mass ratio is a single or more and 10 times or less.

In the aqueous ink, a resin other than a copolymer resin can additionally be used. A preferred content of the copolymer resin relative to all the resins contained in an ink is 50% by mass or more and 100% by mass or less.

The copolymer resin is preferably used by neutralizing all or part of a portion corresponding to an acid monomer by using a base. Preferred example of the neutralized base includes an alkali metal-containing base (e.g. NaOH and KOH), amine (e.g. alkanolamine and alkylamine) and ammonia.

In particular, the copolymer resin is preferably neutralized with an amine whose boiling point is 100° C. or more and 200° C. or less to dissolve the copolymer resin in an ink and improve image durability, such as N,N-dimethylaminoethanol and 2-amono-2-methylpropanol in terms of ejection stability.

If the amount of the neutralized base to be added is too small, effects by neutralization of the copolymer resin cannot be obtained and if it is too large, such problems as image water resistance, discoloration and odor are caused. The chemical equivalent is preferably 0.8 times or more and under 3 times relative to the chemical equivalent of an acid group of said copolymer resin, and the content relative to the ink is preferably 0.1% by mass or more and 1% by mass or less.

Next, a surfactant will be described.

By controlling ink surface tension at a low level by adding a surfactant, no repellency of printed surface is generated on a non-absorbable recording material and a slightly absorbable recording material to control ink mixture and obtain a high-quality printed image.

The surface tension is a force for contractive tendency of the surface of a liquid to minimize a surface area thereof in the liquid. By controlling the surface tension, wettability of a liquid to a solid can be controlled. As the surface tension is low, a liquid can get wet with a hydrophobic base material. The surface tension is classified into static surface tension in which a liquid hardly flows and dynamic surface tension in which an interface flows, both of which are important to form an image with an inkjet.

The ink's static surface tension is a mark of ink wettability to a base material when an ink is printed to form an image. If ink's static surface tension to a hydrophobic base material is high, the ink is splashed within a few seconds after printing to lower image quality. Meanwhile, the dynamic surface tension affects the range of an ink drop at the moment of landing on a base material. If the dynamic surface tension is high, an ink drop doesn't spread, and a dot formed after landing becomes smaller and a solid printing section is not filled with an image to generate a white void.

In an ink using a fixing resin, ink's static surface tension can be increased by storing an ink for a long period of time according to the type of a surfactant. If a stored ink is printed on a non-absorbable recording material and a slightly absorbable recording material, repellency is generated on a printed surface to reduce image quality Inventors of the present invention have the following specific thought on this phenomenon. When a water-soluble fixing resin is particularly used as said fixing resin, the resin has a low acid number, less water-soluble property and a hydrophobic alkyl group. When a surfactant is added to the fixing resin while dissolved in an ink having water as a main component, a surfactant seems to repeat absorption and desorption in the hydrophobic fixing resin. Under the circumstances, if the ink is stored for a long period of time, the surfactant is gradually trapped by the fixing resin as a polymer and fails to be desorbed, thereby reducing the amount of an effectively functioning surfactant and increasing surface tension.

The increase in static surface tension after the ink is stored for a long period of time notably occurs in case of an ink using said fixing resin. Since a significantly water-soluble resin whose normal acid number is large is hydrophilic, the surfactant shows no absorption, and little increase in static surface tension is found even if the ink is stored for a long period of time.

Inventors of the present invention found that no variation in static surface tension is found when a fluorochemical surfactant is used as a surfactant, even if the ink is stored for a long period of time.

This observation is attributed to the following theory. Specifically, a surfactant is trapped by a hydrophobic fixing resin, and as a hydrophobic section in a molecule of the surfactant is longer, it can get trapped in a polymer, resulting in reduction in static surface tension after ink storage. On the other hand, a fluorine-based surfactant is a surfactant using fluorine's powerful hydrophobic action. Even if a hydrophobic section containing a fluorine in a molecule is short, the fluorine-based surfactant sufficiently exhibits a surface activity action, and a hydrophobic section in a molecule is shorter than other surfactants. Therefore, the fluorine-based surfactant cannot readily get trapped by the fixing resin compared to other surfactants, and reduction in static surface tension is not found despite long-time ink storage.

However, if only a fluorochemical surfactant is used as a surfactant, dots formed from an ink drop become smaller than other surfactants to generate a void on an image. This is because a fluorochemical surfactant significantly reduces static surface tension, but doesn't reduce dynamic surface tension so much.

Then, by further using a surfactant of polyoxyethylene alkyl ether for reducing dynamic surface tension in addition to the fluorochemical surfactant, despite long-time storage of an ink using said fixing resin, no variation in static surface tension is found. The repellency after printing can be reduced and no void is generated on an image by dot contraction, and a high-quality image can be continuously formed.

A fluorochemical surfactant will be described.

A fluorochemical surfactant means a surfactant obtained by substituting part or all thereof by a fluorine, instead of a hydrogen bonded to a carbon of a hydrophobic group of a normal surfactant, preferably having a linear or a branched perfluoroalkyl group or a perfluoroalkenyl group in a molecule.

Preferred example of the fluorochemical surfactant includes the one shown by the following general formula (1).

$$R_1—(X_1)_n—Y \qquad \text{General formula (1)}$$

In the formula, $R_1$ represents a linear or a branched perfluoroalkyl group or a perfluoroalkenyl group, $X_1$ represents a bivalent linking group (e.g. an ethylene group, a phenylene group and an oxygen atom), Y represents a water solubilizing group (e.g. an anionic group such as carboxylate and sulfonate, a cationic group such as quaternary ammonium salt, and a nonionic group such as a polyethylene oxide group), and n is an integer of 0 or 1.

Moreover, in a fluorochemical surfactant, if a main chain of the perfluoroalkyl group or perfluoroalkenyl group includes carbon atoms of 3 or more and 6 and less, a surfactant cannot readily be trapped by a fixing resin to further control an increase in static surface tension by long-time ink storage in more preferable manner.

As the fluorochemical surfactant, some products are available from DIC Corporation (Megafac F), Asahi Glass Co., Ltd. (Surflon), 3M Company (Fluorad FC), Imperial Chemical Industries (Monflor), E.I. du Pont de Nemours & Company Inc. (Zonyls), Farbwerke Hoechst (Licowet VPF) and NEOS Co. Ltd. (Ftergent).

Next, a surfactant of polyoxyethylene alkyl ether will be described.

Any surfactant of polyoxyethylene alkyl ether can be used, but preferred example thereof includes the one shown by the following general formula (2).

$$R_2—(X_2)_m—(OCH_2CH_2)_k—OH \qquad \text{General formula (2)}$$

In the formula, $R_2$ represents a linear or a branched alkyl group, $X_2$ represents a bivalent linking group (e.g. an ethylene group, a phenylene group and an oxygen atom), m is an integer of 0 or 1, and k is an integer of 10 to 30.

As a polyoxyethylene alkyl ether, $R_2$ in the general formula preferably represents a linear or a branched alkyl group having carbon atoms of 4 or more and 9 or less in that a surfactant cannot readily be trapped by a fixing resin, more preferably a branched alkyl group.

As the surfactant of the polyoxyethylene alkyl ether, some products are available from BYK Co., Ltd. (BYK-DYNWET 800).

Surfactants other than said surfactant can be added to an aqueous ink, e.g. an anionic surfactant such as dialkylsulfosuccinic acid salts and alkyl naphthalene sulfonate, a nonionic surfactant such as fatty acid salts and acetylenic glycols, and a cationic surfactant such as alkylamine salts and quaternary ammonium salts.

Illustrative example of the pigment used in the ink of the present invention includes a conventionally known organic or inorganic pigment, e.g. an azo-lake, an azo pigment such as an insoluble azo pigment, a condensed azo pigment and a chelate azo pigment, a polycyclic pigment such as a phthalocyanine pigment, a perylene and a perylene pigment, an anthraquinone pigment, a quinacridone pigment, a dioxandine pigment, a thioindigo pigment, anisoindolinone pigment and a quinophthalone pigment, a dye lake such as a basic dye lake and an acid dye lake, an organic pigment such as a nitro pigment, a nitroso pigment, an aniline black and a daylight fluorescent pigment, and an inorganic pigment such as a carbon black.

Preferred example of the organic pigment is shown as follows.

Illustrative example of the pigment for magenta or red includes a C.I. pigment red 2, a C.I. pigment red 3, a C.I. pigment red 5, a C.I. pigment red 6, a C.I. pigment red 7, a C.I. pigment red 15, a C.I. pigment red 16, a C.I. pigment red 48:1, a C.I. pigment red 53:1, a C.I. pigment red 57:1, a C.I. pigment red 122, a C.I. pigment red 123, a C.I. pigment red 139, a C.I. pigment red 144, a C.I. pigment red 149, a C.I. pigment red 166, a C.I. pigment red 177, a C.I. pigment red 178, and a C.I. pigment red 222.

Illustrative example of the pigment for orange or yellow includes a C.I. pigment orange 31, a C.I. pigment orange 43, a C.I. pigment yellow 12, a C.I. pigment yellow 13, a C.I. pigment yellow 14, a C.I., pigment yellow 15, a C.I. pigment yellow 17, a C.I. pigment yellow 74, a C.I. pigment yellow 93, a C.I. pigment yellow 94, a C.I. pigment yellow 128, and a C.I. pigment yellow 138.

Illustrative example of the pigment for green or cyan includes a C.I. pigment blue 15, a C.I. pigment blue 15:2, a C.I., pigment blue 15:3, a C.I. pigment blue 16, a C.I. pigment blue 60, and a C.I. pigment green 7.

The above pigments are process in various manners to produce a pigment dispersion in order to maintain the state of stable dispersion in an aqueous ink.

The dispersion may be any one if it is aqueous and can stably disperse an ink selected from a pigment dispersion dispersed by a dispersing resin of a polymer, a capsule pigment coated with a water-insoluble resin and a self-dispersible pigment that modifies a pigment surface and can be dispersed without using a dispersing resin.

Also, said copolymer resin may be used as a dispersing resin of a pigment.

A method for dispersing a pigment can employ a ball mill, a sand mill, an attritor, a roll mill, an agitator, a Henschel mixer, a colloid mill, an ultrasonic homogenizer, a pearl mill, a wet jet mill, and a paint shaker.

Preferably, coarse grains of said pigment dispersion are removed using a centrifugal separator or a filter.

A capsule pigment coated with a water-insoluble resin may be used as a pigment. The water-insoluble resin is an acidulous or a weakly basic water-insoluble resin, and preferably a resin whose solubility relative to an aqueous solution (pH4 to 10) is 2% by mass or less.

Preferred example of the water-insoluble resin includes acrylic, styrene acrylic, acrylonitrileacrylic, vinyl acetate, vinyl acetate-acrylic, vinyl acetate-vinyl chloride, polyurethane, silicone-acrylic, acrylic silicone, polyester, and epoxy.

As the molecular weight of said dispersing resin or said water-insoluble resin, the weight average molecular weight is preferably 3,000 to 500,000, more preferably 7,000 to 200,000.

Tg of the dispersing resin or the water-insoluble resin is preferably −30° C. to 100° C., more preferably −10° C. to 80° C.

The mass ratio of a pigment and the dispersing resin or the water-insoluble resin is preferably 100/150 or more and 100/30 and less as pigment/resin ratio. If the pigment/resin ratio is under 100/150, a dispersing resin that doesn't absorb in a pigment or a water-insoluble resin that doesn't coat a pigment is present in an ink in large quantities, thereby deteriorating ink ejection stability and preservation stability. In particular, the range of 100/100 or more and 100/40 or less is favorable for image durability, ejection stability and ink storage stability.

The average particle diameter of a pigment coated with said water-insoluble resin is preferably 80 to 150 nm in view of ink preservation stability and coloring property.

Various known methods for coating a pigment with a water-insoluble resin can be used, but preferably a production method for dissolving a water-insoluble resin in an organic solvent such as methyl ethyl ketone, partially or completely neutralizing an acid group in a resin using a base, dispersing the resin by adding a pigment and an ion-exchange water thereto, removing an organic solvent, and adding water as required. Also, a method for dispersing the resin using a polymerizable surfactant, supplying a monomer thereto and coating while polymerizing is preferable.

As a self-dispersible pigment, a commercially available product treated with a surface can be used and preferred example of the self-dispersible pigment includes CABO-JET200, CABO-JET300 (Cabot Corporation) and Bon Jet CW1 (Orient Chemical Industries Co., Ltd.).

The aqueous ink contains a water-soluble organic solvent, and is preferably a water-soluble organic solvent having a low surface tension as a water-soluble organic solvent.

By adding a water-soluble organic solvent having a low surface tension, ink mixture on a recording material composed of various types of hydrophobic resins such as a flexible polyvinyl chloride sheet and less absorbable paper support such as actual printing stock can further be reduced to obtain a high-quality printed image. It is considered that a water-soluble organic solvent having a low surface tension can improve ink wettability relative to vinyl chloride and improve ink thickening property due to drying of moisture in an ink when said copolymer resin is used.

In particular, a glycol ether or a 1,2-alkanediol is preferably added, and specifically the following water-soluble organic solvent having a low surface tension is preferable.

Illustrative example of the glycol ether includes ethylene glycol monoethyl ether, ethylene glycol monobutyl ether, diethylene glycol monoethyl ether, diethylene glycol monobutyl ether, triethylene glycol monobutyl ether, propylene glycol monopropyl ether, dipropylene glycol monomethyl ether, dipropylene glycol propyl ether, and tripropylene glycol monomethyl ether.

Illustrative example of the 1,2-alkanediol includes 1,2-butanediol, 1,2-pentanediol, 1,2-hexanediol and 1,2-heptanediol.

Also, a solvent that can dissolve, soften or swell a recording material such as vinyl chloride is preferably added. Adhesive property of the vinyl chloride and the copolymer resin is further improved and image adhesive property and wear resistance are preferably improved.

Illustrative example of the solvent includes a cyclic solvent containing a nitrogen or a sulfur atom, cyclic ester solvent, lactalate ester, alkylene glycol diether, alkylene glycol monoether monoester, and dimethyl sulfoxide.

Preferred example of the cyclic solvent containing the nitrogen atom includes a cyclic amide compound with 5 to 8 membered ring, e.g. 2-pyrrolidone, N-methyl-2-pyrrolidone, N-ethyl-2-pyrrolidone, 13-dimethyl-2-imidazolidinone, ϵ-caprolactam, methyl caprolactam, and 2-azacyclooctanone.

Preferred example of the cyclic solvent containing the sulfur atom includes a cyclic 5 to 7 membered ring, e.g. sulfolane.

Preferred example of the cyclic ester solvent includes γ-butyrolactone and ϵ-caprolactone, and preferred example of the lactalate ester includes butyl lactate and ethyl lactate.

Preferred example of the alkylene glycol diether includes diethylene glycol diethyl ether.

Preferred example of the alkylene glycol monoether monoester includes diethylene glycol monoethyl monoacetate.

Other example includes an alcohol (e.g. methanol, ethanol, propanol, isopropanol, butanol, isobutanol, secondary butanol, tertiarty butanol), a polyvalent alcohol (e.g. ethylene glycol, diethylene glycol, triethylene glycol, polyethylene glycol, propylene glycol, dipropylene glycol, polypropylene glycol, butylene glycol, hexanediol, pentanediol, glycerine, hexanetriol, thiodiglycol), an amine (e.g. ethanol amine, diethanol amine, triethanol amine, N-methyl diethanol amine, N-ethyl diethanol amine, morpholine, N-ethyl morpholine, ethylene diamine, diethylene diamine, triethylene tetramine, tetraethylene pentamine, polyethyleneimine, pentamethyl diethylene triamine, tetramethylpropylene diamine), and an amide (e.g. formamide, N,N-dimethyl formamide, N,N-dimethyl acetamide).

(UV Ink)

In the present invention, as an ink containing a pigment, a UV ink containing a pigment can be used in addition to the above described aqueous inks Generally, a UV ink is of a high viscosity and fails to widen the dot diameter of an ink drop landed, thereby readily generating a void and a white stripe in a solid portion. However, even if an image is recorded on a non-absorbable or a slightly absorbable recording material using a UV ink by an effect of increasing the flow rate of an ink drop in the present invention, the dot diameter can be widened, thereby recording and forming a high quality image whose generation of a void and a white stripe is reduced.

Illustrative example of a photoreactive resin used for a UV ink includes a polymerizable monomer and a polymerizable oligomer. Preferred example of the polymerizable monomer includes a radically polymerizable monomer and a cationic polymerizable monomer. A polyfunctional monomer such as monofunctional, bifunctional, and trifunctional monomers are preferably used. A conventionally known photoradical initiator and a photocationic initiator can be used.

When the UV ink is used, the inkjet recording device 1 is provided with an ultraviolet ray irradiating means (not shown) such as a UV lamp for irradiating a ultraviolet ray toward a surface of the recording material P just after an image is recorded and formed by the record head 3.

(Heating Process of Recording Material)

The inkjet recording method according to the present invention preferably has a heating process for heating the recording material P from a rear surface of an image-recording surface at least in any one of cases where the recording material P is heated before, while and after recording an image. In particular, when the above aqueous inks are used, a significantly glossy image having high wear resistance and adhesive property can be recorded and formed. The recording material P is heated from the rear surface of the image-recording surface thereof, thereby causing no damage to the image.

The heating means may be the one if it can heat the rear surface of the image-recording surface of the recording material P at a predetermined temperature in a contact or non-contact manner, but not particularly restricted thereto. As shown in FIG. 1, a flat heater 6 is disposed on a surface opposite to the record head 3 so as to sandwich the endless belt 23 to heat the rear surface of the image-recording surface in the recording material P placed on the endless belt 23 by the flat heater 6.

By setting the size and position of the flat heater 6 accordingly, the heating portion can be set at the upstream side of the record head 3 (before recording an image), just below the record head 3 (while recording an image), or at the downstream side of the record head 3 (after recording an image). Also, heating of the record head 3 may not be restricted to any one of upstream side, just below and downstream side, but any two or more thereof. FIG. 1 shows one embodiment of heating the record head 3 in a wide range from the upstream side to the downstream side by the flat heater 6.

Also, the recording material P placed on an upper surface of the endless belt 23 may be heated via the endless belt 23 using a heating roller (not shown) obtained by providing a heat source such as a halogen lamp inside either or both of rollers 21,22 for rotating driving the endless belt 23.

Figure 21:
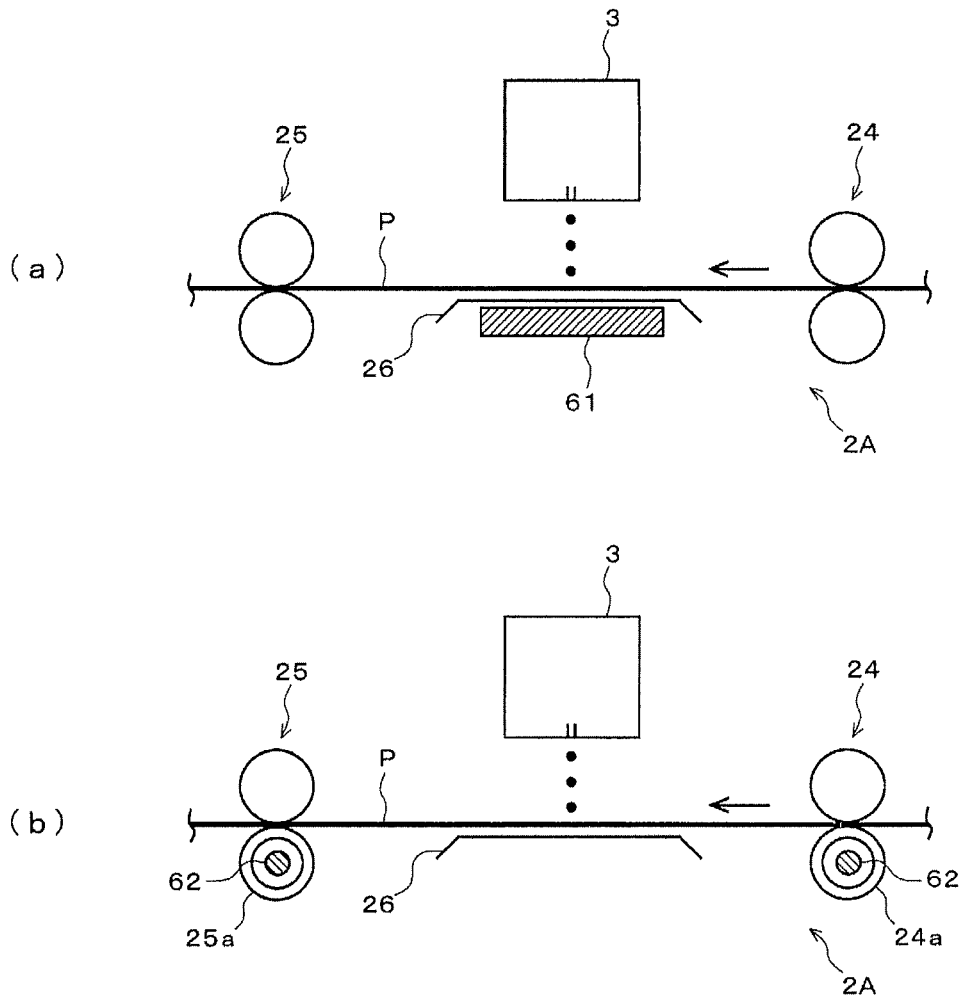
FIGS. 21 (*a*) and (*b*) are figures describing a process of heating a recording material.

Furthermore, as a conveying means for conveying the recording material P, instead of the endless belt 23 shown in FIG. 1, but as shown in FIG. 21(*a*), in case of an inkjet recording device having a conveying means 2A for conveying the recording material P at the upstream side and the downstream side sandwiching the record head 3 while sandwiching by a pair of rollers 24,25, a heating portion 61 such as the above flat heater may be provided at a platen 26 for supporting the rear surface of the recording material P. As shown in FIG. 21(*b*), out of a pair of rollers 24,25 for conveying the recording material P, the rear surface of the recording material P may be heated at support roller 24*a*,25*a* disposed on the rear surface of the recording material P so as to contact with the heating roller, using a heating roller inside which a heat source 62 such as a halogen lamp is provided. The heat source 62 may be any one of the support rollers 24*a* and 25*a*.

The heating temperature is preferably 30° C. or more and 70° C. or less. If the temperature is set at 30° C. or more, a printed material becomes glossier and if the temperature is 70° C. or less, the recording material P is not deformed and is free from conveying problem.

(Drying Process of Recording Material)

In addition to the above heating process, or instead of the heating process, a drying process for drying the recording material P after recording an image is preferably provided.

The drying means is not particularly restricted, but in case of contact drying like the above heating means, a heating roller and a flat heater are contacted with the rear surface of the recording material P to heat and dry the recording material P. In case of non-contact heating, a method for blowing hot air from an image-recording surface of the recording material P by a drier and a method for using radiation heat such as an infrared ray with a halogen lamp can be used. FIG. 1 shows one embodiment of a drying apparatus 7 for drying the recording material P carried from the conveying means 2 by blowing hot air to the same provided at the downstream side of the conveying means 2 in addition to a heating process.

Other drying means includes a method for removing volatile components in an ink by treatment under reduced pressure, and a method for drying with an electromagnetic wave such as a microwave. The drying means may be not only used as any one thereof, but also in combination with one or more types thereof accordingly.

The drying temperature is preferably 30° C. or more and 70° C. or less. If the temperature is set at 30° C. or more, a printed material becomes favorably glossier and if the temperature is 70° C. or less, the recording material P is not deformed and free from conveying problem.

EXAMPLE

The effects of the present invention will be described with reference to Examples, but the present invention is not restricted to the following Examples.

<Ink 1>

(Preparation of Cyan Pigment Dispersion)

A DISPERBYK-190 (BYK Co., Ltd.) (15% by mass) was added to an ion-exchange water (60% by mass) as a pigment dispersant, with which a 2-pyrrolidinone (10% by mass) was mixed. A C.I. pigment blue 15:3 (15% by mass) was added to the solution and premixed, and then dispersed using a sand grinder in which 0.5 mm zirconia beads (50% by mass at volume concentration) were filled to obtain a cyan pigment dispersion(pigment solid content: 15% by mass).

(Preparation of Ink 1)

An ion-exchange water (33.5% by mass), a dipropylene glycol propyl ether (10% by mass), a dipropylene glycol methyl ether (10% by mass), a 2-pyrrolidinone (5% by mass), a fluorochemical surfactant (Megafac)F (0.5% by mass) and a surfactant of a polyoxyethylene alkyl ether BYK-DYNWET800 (BYK Co., Ltd.) (1% by mass) were added to a JONCRYL70J (BASF) (20% by mass) to be agitated. Next, said cyan pigment dispersion (20% by mass) was added to said agitated liquid mixture, filtered with a 1 μm filter and agitated to obtain an ink 1 composed of an aqueous ink.

The surface tension measured was 26 mN/m using a surface tension balance CBVP type A-3 (Kyowa Interface Science Co., Ltd.).

<Ink 2>

An ink 2 composed of a UV ink of the following composition was obtained.

Pigment: pigment red 122 (magenta pigment); 4.10% by mass

Pigment dispersant: Ajisper PB822 (Ajinomoto Fine-Techno Co., Inc.); 1.60% by mass Oxetane compound: OXT221 (Toagosei Co., Ltd.); 38.26% by mass OXT212 (Toagosei Co., Ltd.); 15.00% by mass Alicyclic epoxy: CEL 2021P (Daicel Corporation, molecular weight 252); 10.00% by mass CYM M100 (Daicel Corporation, molecular weight 196); 20.00% by mass Photoacid generator: CPI-100 (San-Apro Ltd., propylene carbonate 50% solution); 8.00% by mass Sensitizer: DEA (Kawasaki Kasei Chemicals); 2.00% by mass Sensitization aid: IRGANOX1076 (BASF); 1.00% by mass Surfactant: KF351 (Shin-Etsu Chemical Co., Ltd.); 0.04% by mass The surface tension measured was 31 mN/m as the ink 1.

Example 1 to 7

Comparative Example 1 to 3

Using a sharing mode type record head (nozzle diameter: 27 μm, nozzle density: 360 dpi, distance between nozzle surface and recording material: 2 mm) like in FIG. 2, the record head was driven by 3-cycle driving method using a drive pulse composed of a square wave (1AL=5.1 μs, drive voltage ratio=|+Von/−Voff|=2/1) like in FIG. 4.

The pressure on a meniscus in nozzles was at −10 cmAq in all the Examples 1 to 7 and Comparative Examples 1 to 3, and each of the following evaluations was made when the pulse width W1 of a first drive pulse was changed as shown in Table 1 in Examples 1 to 7 and Comparative Examples 1 to 3.

The pulse width W2 of a second drive pulse was all 2AL, and the drive voltage of the first drive pulse +Von was adjusted as shown in Table 1 while each drive voltage ratio=|+Von/−Voff|=2/1 was maintained, so that the droplet speed after 0.5 mm flight from the nozzle surface was the speed shown in Table 1.

Evaluation 1: White Stripe Evaluation

A recording material (PVC film) is conveyed at a conveying speed of 1 m/s using a line-type record head to form a 5 cm square solid image. The recording material was visually evaluated in that whether a white stripe is found or not according to the following standards.

◎: Favorable image with no white stripe is obtained.

○: A white stripe is partially found, but within an allowable level.

Δ: A white stripe occupies an image with about one half thereof.

X: A white stripe entirely occupies an image.

Evaluation 2: Impact Position Displacement Evaluation

A one-dot thin line perpendicular to a conveying direction of the recording material is plotted with 2 bidirectional printing paths using a serial-type record head to evaluate dot displacement relative to a thin line according to the following standards. The drive frequency was set at 10 kHz.

◎: A favorable with no impact position displacement is obtained.

○: Impact position displacement is visually confirmed, but within an allowable level.

Δ: Impact position displacement of 0.1 to 0.5 mm is found.

X: Impact position displacement of 0.5 to 1 mm is found.

Evaluation 3: Ejection Stability when Even/Odd Nozzles are Switched to Drive

Single ejection was evaluated using the record head in Evaluation 1. Stable ejection property was evaluated with a drive cycle of 5AL to eject by switching an even-numbered nozzle and an odd-numbered nozzle a second according to the following standards.

◎: No ink void (no ejection) is found at a droplet speed of 7 m/s or more and an ink can be favorably ejected.

○: No ink void is found at a droplet speed of 6 m/s or more and an ink can be favorably ejected.

Δ: No ink void is found at a droplet speed of 5 m/s or more and an ink can be favorably ejected.

X: Ink void and curve are generated at a droplet speed of 4 to 5 m/s.

Evaluation 4: Measurement of Drive Voltage and Flow Rate

Single ejection was evaluated using the record head in Evaluation 1, and the drive voltage of the first drive pulse +Von and the flow rate at a droplet speed shown in Table 1 were measured. The drive frequency was set at 10 kHz.

TABLE 1

| | Ink | W1 [μs] | W1/AL | droplet speed | Evaluation 1 | Evaluation 2 | Evaluation 3 | Evaluation 4 Flow rate [pl] | Evaluation 4 Voltage [V] |
|---|---|---|---|---|---|---|---|---|---|
| Comparative Example 1 | Ink 1 | 4.6 | 0.9 | 6 m/s | X | X | ◎ | 12.6 | 13.4 |
| Comparative Example 2 | Ink 1 | 6.4 | 1.3 | 6 m/s | X | Δ | ○ | 14.1 | 14.3 |
| Example 1 | Ink 1 | 6.9 | 1.4 | 6 m/s | ○ | ◎ | ○ | 15.5 | 15.8 |
| Example 2 | Ink 1 | 6.9 | 1.4 | 4 m/s | ○ | ○ | ○ | 14.5 | 13.9 |
| Example 3 | Ink 1 | 6.9 | 1.4 | 9 m/s | ◎ | ○ | ○ | 18.1 | 18.5 |
| Example 4 | Ink 1 | 7.7 | 1.5 | 6 m/s | ◎ | ◎ | ○ | 16.5 | 18.3 |
| Example 5 | Ink 2 | 7.7 | 1.5 | 6 m/s | ◎ | ◎ | ○ | 16.7 | 16.4 |
| Example 6 | Ink 1 | 8.7 | 1.7 | 6 m/s | ◎ | ◎ | Δ | 20.7 | 21.5 |
| Comparative Example 3 | Ink 1 | 9.2 | 1.8 | 6 m/s | Δ | ○ | X | 23.3 | 24.3 |
| Example 7 | Ink 1 | 8.2 | 1.6 | 8 m/s | ◎ | ○ | Δ | 19.3 | 19.0 |

As shown in Table 1, Evaluations 1 to 3 in Examples 1 to 7 of the present invention show evaluations of 2 or more, and the dot diameter so as to generate no white stripe or show a white stripe within an allowable level, and the flow rate of an ink drop was sufficiently obtained.

Nevertheless, in Comparative Examples 1 and 2, the pulse width W1 of the first drive pulse was out of range of the present invention. The dot diameter was small and the white stripe was generated in the entire image, with a significant impact position displacement in Comparative Example 1 in particular. Comparative Example 3 exhibits a large dot diameter, but the drive voltage significantly increases, resulting in poor ejection stability to drive when even/odd nozzles are switched and ink void and curve.

Although Example 2 shows no practical problems, the droplet speed after 0.5 mm flight from a nozzle surface is a little small at 4 m/s to generate a slight impact position displacement attributable to the small droplet speed.

In addition, although Example 3 shows no practical problems, the droplet speed after 0.5 mm flight from a nozzle surface is a little high at 9 m/s to generate a slight satellite attributable to the high droplet speed.

Example 8 to 12

Comparative Example 4 to 5

The record head was driven by 3-cycle driving method using a drive pulse composed of a square wave (1AL=5.1 μs, drive voltage ratio=|+Von/−Voff|=2/1) like in FIG. 4 by using the above sharing mode type record head (nozzle diameter: 27 μm, nozzle density: 360 dpi, distance between nozzle surface and recording material: 2 mm). Each ink used was ink 1.

The pulse width W1 of the first drive pulse was all fixed to 7.7 μs (=1.5AL), and when the pressure on the meniscus in the nozzles was changed as shown in Table 2 in Examples 8 to 12 and Comparative Examples 4 to 5, the following Evaluation 5 was performed in addition to said Evaluation 1: white stripe evaluation and said Evaluation 3: ejection stability evaluation to drive when even/odd nozzles are switched. In Evaluation 1, the drive voltage of the first drive pulse +Von was set while maintaining the drive voltage ratio=|+Von/−Voff|=2/1 so that the droplet speed after 0.5 mm flight from nozzle surface is 6 m/s.

The pulse width W2 of the second drive pulse was changed as shown in Table 2.

Evaluation 5: Continuous Ejection Stability Evaluation

Single ejection was evaluated using the record head in Evaluation 1. Stable ejection property with continuous 60-channel drive was evaluated with a drive cycle of 5AL according to the following standards.

◎: No ink void (non-ejection) is found and an ink is favorably ejected at a droplet speed of 8 m/s or more.

○: No ink void is found and an ink is favorably ejected at a droplet speed of 6 m/s or more.

Δ: No ink void is found and an ink is favorably ejected at a droplet speed of 5 m/s or more.

X: An ink void and a curve are generated at a droplet speed of 4 to 5 m/s.

TABLE 2

| | Water head value | W2 [μs] | Evaluation 1 | Evaluation 3 | Evaluation 5 |
|---|---|---|---|---|---|
| Example 8 | −19 cmAq | 10.2 | ○ | ○ | ○ |
| Example 9 | −14 cmAq | 10.2 | ◎ | ◎ | ◎ |
| Example 10 | −5 cmAq | 10.2 | ◎ | ○ | ◎ |
| Example 11 | −19 cmAq | 9.0 | ○ | Δ | ○ |
| Example 12 | −19 cmAq | 12.0 | ○ | ○ | Δ |
| Comparative Example 4 | −22 cmAq | 10.2 | X | Δ | X |

TABLE 2-continued

| | Water head value | W2 [μs] | Evaluation 1 | Evaluation 3 | Evaluation 5 |
|---|---|---|---|---|---|
| Comparative Example 5 | −2 cmAq | 10.2 | ◎ | X | ○ |

As shown in Table 2, Evaluations 1, 3, 5 in Examples 8 to 12 of the present invention all exhibited evaluations of 2 or more, and the dot diameter is determined so as to generate no white stripe or come within an allowable level, and the flow rate of an ink drop was sufficient.

Nevertheless, in Comparative Example 4, the pressure on the meniscus in the nozzles was out of the range of the present invention (under −20 cmAq) and the impact of increase in flow rate of an ink drop was not obtained. Particularly in Comparative Example 4, meniscus break was generated in Evaluation 5 and in Comparative Example 5, the pressure on the meniscus in the nozzles was out of range of the present invention (−5 cmAq or more) to increase meniscus extrusion when adjacent nozzles were driven and obtain unfavorable ejection stability.

Example 11 shows no practical problems, but since the pulse width W2 of the second drive pulse is 2AL or less, adjacent nozzles were canceled at an earlier stage. Also, there was a slight increase in extrusion of the meniscus to drive when even/odd nozzles were switched, and Evaluation 3 was given an evaluation of 2.

Example 12 shows no practical problems, but since the pulse width W2 of the second drive pulse is 2AL or more, the suspension period until the start of the next ejection becomes shorter, thereby obtaining a slight unstable evaluation of 2 regarding continuous ejection in Evaluation 5.

EXPLANATIONS OF LETTERS OR NUMERALS

1: Inkjet recording device
22A: Conveying means
21,22: Roller
23: Endless belt
24,25: Pair of rollers
24*a*,25*a*: Support roller
3: Record head
31,31A to 31C: Channel (Pressure-generating chamber)
32,32*a* to 32D: Walls (Electromechanical conversion means)
32*a*: Upper wall portion
32*b*: Lower wall portion
33: Cover substrate
33*a*: Common flow passage
34: Nozzle plate
34*a*: Nozzle
341: Nozzle surface
35: Plate
35*a*: Ink supply port
36A to 36C: Drive electrode
4: Drive pulse generating portion
5: Ink supply portion
51: Main tank
52,53: Ink supply tube
54: Liquid feed pump
5555*a*: Sub tank
550: Casing
550*a*: Reference plane
551: Concave portion
551*a*: Opening
552: Flexible film
553: Internal space
554: Elastic member
555: Biasing force adjusting screw
56: Liquid quantity detection apparatus
57: Pressure detection apparatus
58: Atmosphere open valve
59: On-off valve
6: Flat heater
61: Heating portion
62: Heat source
7: Drying apparatus
40,400,403: Drive pulse
41,401,404: First drive pulse
42,402,405: Second drive pulse
100: Velocity detector
101: Detection light
102: Light emitting element
103: Light receiving element

The invention claimed is:

1. An inkjet recording device comprising:

a plurality of pressure-generating chambers compartmented by walls comprising electromechanical conversion devices for generating a pressure by deforming said walls by operating said electromechanical conversion devices;

nozzles connected to the pressure-generating chambers for ejecting ink drops by operating the pressure;

an ink supply portion for supplying an ink containing a pigment to said pressure-generating chambers; and a drive pulse generation device for driving said electromechanical conversion devices, wherein by separating said pressure-generating chambers into a plurality of groups, one group consisting of adjacent 3 pressure-generating chambers sandwiching said walls, said pressure-generating chambers in each group are driven in series so as to eject ink drops from said nozzles, wherein said drive pulse generation device ejects an ink drop from said nozzle by applying a first drive pulse for generating a negative pressure in said pressure-generating chamber on condition that the applying pressure on a meniscus in said nozzle is set within a range of −20 cmAq or more and −5 cmAq or less, and a second drive pulse for subsequently generating a positive pressure in said pressure-generating chamber to said electromechanical conversion device and the pulse width W1 of said first drive pulse is set within a range of $1.5AL \leq W1 < 1.8AL$ on condition that AL is one half of the acoustic resonance of a pressure wave in said pressure-generating chamber.

2. The inkjet recording device according to claim 1, wherein the pulse width W2 of said second drive pulse is 2AL.

3. The inkjet recording device according to claim 1, wherein said first drive pulse and said second drive pulse are a square wave.

4. The inkjet recording device according to claim 1, wherein said drive pulse generation device applies said first drive pulse and said second drive pulse to said electromechanical conversion device of said pressure-generating chamber for ejecting an ink drop from said nozzle, and applies only said second drive pulse to said electromechanical conversion device of said pressure-generating chamber for ejecting no ink drop from said nozzle.

5. The inkjet recording device according to claim 1, wherein the speed of an ink drop from said nozzle after 0.5 mm flight is 6 m/s or more and 8 m/s or less.

6. The inkjet recording device according to claim 1, wherein said ink is an aqueous ink.

7. The inkjet recording device according to claim 1, wherein said ink is a UV ink.

8. An inkjet recording method, wherein an image is recorded by ejecting an ink on a non-absorbable recording material or a slightly absorbable recording material as a recording material using the inkjet recording device according to claim 1.

9. The inkjet recording method according to claim 8, wherein a process of heating said recording material from a rear surface of an image-recording surface at least in any one of cases where said recording material is heated before, while and after recording an image is included.

* * * * *